US009182688B2

(12) United States Patent
Kadota et al.

(10) Patent No.: US 9,182,688 B2
(45) Date of Patent: Nov. 10, 2015

(54) IMAGE FORMING APPARATUS, IMAGE FORMING METHOD AND PROCESS CARTRIDGE

(71) Applicants: Takuya Kadota, Hyogo (JP); Yoshihiro Mikuriya, Hyogo (JP); Tsuyoshi Nozaki, Osaka (JP); Yoshimichi Ishikawa, Hyogo (JP); Kazuoki Fuwa, Hyogo (JP); Tomohiro Fukao, Osaka (JP); Yuta Takeuchi, Hyogo (JP); Tomoharu Miki, Osaka (JP); Takayuki Nakamura, Osaka (JP); Naoki Nakatake, Hyogo (JP); Yasuhide Matsuno, Osaka (JP)

(72) Inventors: Takuya Kadota, Hyogo (JP); Yoshihiro Mikuriya, Hyogo (JP); Tsuyoshi Nozaki, Osaka (JP); Yoshimichi Ishikawa, Hyogo (JP); Kazuoki Fuwa, Hyogo (JP); Tomohiro Fukao, Osaka (JP); Yuta Takeuchi, Hyogo (JP); Tomoharu Miki, Osaka (JP); Takayuki Nakamura, Osaka (JP); Naoki Nakatake, Hyogo (JP); Yasuhide Matsuno, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/089,012

(22) Filed: Nov. 25, 2013

(65) Prior Publication Data

US 2014/0147784 A1 May 29, 2014

(30) Foreign Application Priority Data

Nov. 29, 2012 (JP) ..... 2012-261531

(51) Int. Cl.

| | |
|---|---|
| ***G03G 9/08*** | (2006.01) |
| ***G03G 9/087*** | (2006.01) |
| ***G03G 9/097*** | (2006.01) |
| ***G03G 15/08*** | (2006.01) |

(52) U.S. Cl.

CPC ..... *G03G 9/08* (2013.01); *G03G 9/0827* (2013.01); *G03G 9/08782* (2013.01); *G03G 9/09716* (2013.01); *G03G 9/09725* (2013.01); *G03G 15/0813* (2013.01)

(58) Field of Classification Search

CPC ..... G03G 5/10; G03G 5/04; G03G 5/0614; G03G 15/0896; G03G 2221/163; G03G 21/16; G03G 21/007; G03G 21/0011; G03G 21/10

See application file for complete search history.

(56) References Cited

U.S. PATENT DOCUMENTS

| | | | | |
|---|---|---|---|---|
| 6,096,467 | A * | 8/2000 | Shimizu et al. | 430/108.2 |
| 6,183,927 | B1 * | 2/2001 | Magome et al. | 430/108.3 |
| 6,991,885 | B2 * | 1/2006 | Ojima et al. | 430/110.3 |
| 7,720,428 | B2 | 5/2010 | Hagi et al. | |
| 8,110,330 | B2 | 2/2012 | Ishikawa et al. | |
| 8,257,891 | B2 | 9/2012 | Nakatake et al. | |
| 8,338,066 | B2 | 12/2012 | Nozaki et al. | |
| 2001/0018158 | A1 * | 8/2001 | Yoshida et al. | 430/125 |
| 2003/0138267 | A1 | 7/2003 | Yamazaki et al. | |
| 2003/0162116 | A1 * | 8/2003 | Katsuta et al. | 430/108.23 |
| 2005/0100808 | A1 | 5/2005 | Hashimoto et al. | |
| 2005/0284778 | A1 | 12/2005 | Yamazaki et al. | |
| 2006/0069605 | A1 | 3/2006 | Hatoun | |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |
| 2006/0292474 | A1 | 12/2006 | Mikuriya et al. | |
| 2007/0026335 | A1 | 2/2007 | Yamamoto et al. | |
| 2007/0059625 | A1 | 3/2007 | Yamamoto et al. | |
| 2007/0122729 | A1 | 5/2007 | Katoh et al. | |
| 2007/0147893 | A1 | 6/2007 | Nakatake et al. | |
| 2007/0148568 | A1 | 6/2007 | Kadota et al. | |
| 2007/0166635 | A1 | 7/2007 | Yamamoto et al. | |
| 2007/0190442 | A1 | 8/2007 | Nakamura et al. | |
| 2007/0190443 | A1 | 8/2007 | Hagi et al. | |
| 2007/0207399 | A1 | 9/2007 | Kadota et al. | |
| 2007/0212630 | A1 | 9/2007 | Yasunaga et al. | |

(Continued)

FOREIGN PATENT DOCUMENTS

| | | |
|---|---|---|
| EP | 1 544 684 A1 | 6/2005 |
| JP | 2002-214835 | 7/2002 |

(Continued)

OTHER PUBLICATIONS

Extended European Search Report issued Apr. 4, 2014 in EP13195061.0.

*Primary Examiner* — Hoa V Le

(74) *Attorney, Agent, or Firm* — Oblon, McClelland, Maier & Neustadt, L.L.P.

(57) ABSTRACT

An image forming apparatus, including:

an electrostatic latent image bearing member;

an electrostatic latent image forming unit configured to form an electrostatic latent image on the electrostatic latent image bearing member; and a developing unit containing a toner and configured to develop the electrostatic latent image with the toner to thereby form a visible image, wherein the developing unit is a contact type one-component developing unit which includes a toner bearing member being in contact with the electrostatic latent image bearing member, wherein a contact pressure between the electrostatic latent image bearing member and the toner bearing member is $2.0\times10^4$ N/m$^2$ to $7.5\times10^4$ N/m$^2$, wherein the toner contains a binder resin and a releasing agent, and wherein an extracted amount of the releasing agent extracted with hexane from the toner is 10 mg/g to 25 mg/g.

9 Claims, 4 Drawing Sheets

(56) References Cited

U.S. PATENT DOCUMENTS

2007/0217842 A1 9/2007 Kato et al.
2007/0218384 A1 9/2007 Matsumoto et al.
2007/0218388 A1 9/2007 Kurose et al.
2007/0218390 A1 9/2007 Nozaki et al.
2007/0218393 A1 9/2007 Nozaki et al.
2007/0238042 A1 10/2007 Yasunaga et al.
2008/0032223 A1 2/2008 Yamamoto et al.
2008/0038656 A1 2/2008 Yasunaga et al.
2008/0063957 A1 3/2008 Murakami et al.
2008/0069598 A1 3/2008 Murakami et al.
2008/0069608 A1 3/2008 Katoh et al.
2008/0069617 A1 3/2008 Matsumoto et al.
2008/0070149 A1 3/2008 Kato et al.
2008/0076054 A1 3/2008 Nozaki et al.
2008/0081273 A1 4/2008 Murakami et al.
2008/0096119 A1 4/2008 Yamamoto et al.
2008/0101823 A1 5/2008 Katoh et al.
2008/0124635 A1 5/2008 Nakamura et al.
2008/0131162 A1 6/2008 Nakatake et al.
2008/0153018 A1 6/2008 Mikuriya et al.
2008/0159777 A1 7/2008 Fuwa et al.
2008/0175630 A1 7/2008 Yasunaga et al.
2008/0176159 A1 7/2008 Matsumoto et al.
2008/0220357 A1 9/2008 Nozaki et al.
2008/0226356 A1 9/2008 Yasunaga et al.
2008/0227001 A1 9/2008 Kadota et al.
2008/0227009 A1 9/2008 Fuwa et al.
2008/0227013 A1 9/2008 Kadota et al.
2008/0227016 A1 9/2008 Nozaki et al.
2008/0232857 A1 9/2008 Matsumoto et al.
2008/0233497 A1 9/2008 Yamamoto et al.
2008/0233506 A1 9/2008 Hagi et al.
2008/0233510 A1 9/2008 Nozaki et al.
2008/0233511 A1 9/2008 Ishikawa et al.
2008/0279591 A1 11/2008 Yasunaga et al.
2008/0304875 A1 12/2008 Katoh et al.
2008/0310896 A1 12/2008 Shono et al.
2009/0017391 A1 1/2009 Yamamoto et al.
2009/0035681 A1* 2/2009 Yuasa et al. ..... 430/108.4
2009/0041491 A1 2/2009 Shono et al.
2009/0041511 A1 2/2009 Fuwa et al.
2009/0052952 A1 2/2009 Katoh et al.
2009/0117481 A1 5/2009 Yasunaga et al.
2009/0142683 A1 6/2009 Hashimoto et al.
2009/0162772 A1 6/2009 Fuwa et al.
2009/0169270 A1 7/2009 Fuwa et al.
2009/0186289 A1 7/2009 Nakamura et al.
2009/0186291 A1 7/2009 Mikuriya et al.
2009/0220879 A1 9/2009 Matsumoto et al.
2009/0232542 A1 9/2009 Yamamoto et al.
2009/0233199 A1 9/2009 Nozaki et al.
2009/0238617 A1 9/2009 Nakatake
2009/0257792 A1 10/2009 Nakamura et al.
2009/0297975 A1 12/2009 Ishikawa et al.
2009/0297976 A1 12/2009 Yamamoto et al.
2010/0009282 A1 1/2010 Katoh et al.
2010/0150609 A1 6/2010 Nozaki et al.
2010/0167196 A1 7/2010 Hagi et al.
2010/0239974 A1 9/2010 Nozaki et al.
2011/0045401 A1 2/2011 Murakami et al.
2011/0053063 A1 3/2011 Kadota et al.
2011/0053071 A1 3/2011 Miki et al.
2011/0053077 A1 3/2011 Mikuriya et al.
2011/0064473 A1 3/2011 Fujita et al.
2011/0164901 A1 7/2011 Yamamoto et al.
2011/0188896 A1 8/2011 Sakaya et al.
2011/0194864 A1 8/2011 Nakatake et al.
2011/0217055 A1 9/2011 Takehara et al.
2011/0217644 A1 9/2011 Yamamoto et al.
2011/0244383 A1 10/2011 Yamamoto et al.
2011/0250533 A1 10/2011 Kadota et al.
2011/0287356 A1 11/2011 Fukao et al.
2012/0021349 A1* 1/2012 Tani et al. ..... 430/109.4
2012/0033982 A1 2/2012 Kubota et al.
2012/0033996 A1 2/2012 Takehara et al.
2012/0045254 A1 2/2012 Inoue et al.
2012/0189327 A1 7/2012 Kubota et al.
2012/0189350 A1 7/2012 Kubota et al.
2012/0219321 A1 8/2012 Fukao et al.
2012/0237227 A1 9/2012 Takane et al.
2012/0237253 A1 9/2012 Fukao et al.
2012/0237267 A1 9/2012 Fukao et al.
2012/0251938 A1 10/2012 Yamamoto et al.
2012/0264048 A1 10/2012 Ishikawa et al.
2012/0328976 A1 12/2012 Seki et al.
2013/0028638 A1 1/2013 Tsuritani et al.
2013/0029260 A1 1/2013 Nozaki et al.
2013/0058670 A1 3/2013 Nakatake et al.

FOREIGN PATENT DOCUMENTS

JP 2003-035968 2/2003
JP 2003-207925 7/2003
JP 2008-262172 10/2008
JP 2009-025613 2/2009
JP 2009-109945 5/2009
JP 2009-145488 7/2009
JP 2010-243905 10/2010
JP 2011-133518 7/2011

* cited by examiner

IMAGE FORMING APPARATUS, IMAGE FORMING METHOD AND PROCESS CARTRIDGE

BACKGROUND OF THE INVENTION

1. Field of the Invention

The present invention relates to an image forming apparatus, an image forming method, and a process cartridge.

2. Description of the Related Art

Researches and developments of electrophotography have been conducted with various inventive ideas and technical approaches. In electrophotography, an electrostatic latent image is formed by charging and exposing a surface of an electrostatic latent image bearing member. The electrostatic latent image is developed with a color toner to form a toner image. Then, the toner image is transferred onto a recording medium such as transfer paper, and fixed by, for example, a heat roller to thereby form an image. The toner remaining on the electrostatic latent image bearing member without being transferred is removed by, for example, a cleaning blade.

In recent years, color image forming apparatus using electrophotography have broadly been employed, and digitized images are easily available. Thus, it is desired to make an image to be printed at higher definition. Based on a study on higher resolution and gradation of an image, a spherical toner was developed in order to faithfully reproduce an electrostatic latent image. Also, the spherical toner has been researched to be further spheroidized and small-sized. Toners produced by the pulverizing methods have limitations in the above properties, i.e., sphericity and size. Therefore, so-called polymerized toners produced by a suspension polymerization method, an emulsion polymerization method or a dispersion polymerization method, which are capable of being spheroidized and small-sized, have been employed.

However, in the case of the polymerized toner, deterioration of cleanability due to its sphericity has been problematic.

In the electrophotographic image forming apparatus, a method has been widely used in which a toner image formed on an electrostatic latent image bearing member serving as an image bearing member is transferred onto a recording medium, followed by applying heat and pressure at a fixing step to thereby fix the toner image on the recording medium.

During fixing, the recording medium may be wound around a fixing roller, which is problematic. This problem has been solved by adding a releasing agent into a toner.

Although a large amount of the releasing agent present on a toner surface permits fixability to be improved, it has been problematic in that an electrostatic latent image bearing member may be contaminated due to migration of the releasing agent and an external additive to the electrostatic latent image bearing member.

That is, in the case of the spherical toner, a residual toner remaining on the electrostatic latent image bearing member is difficult to be removed. Additionally, when an unnecessarily large amount of the releasing agent is present on the toner surface, it has been problematic in that the residual toner remaining on the electrostatic latent image bearing member may easily cause image loss.

In recent years, a contact type one-component development has been employed in order to respond to a demand for small-sizing. In the contact type one-component developing system, a surface of an electrostatic latent image bearing member is in contact with a surface of a toner bearing member in a developing apparatus, and the toner bearing member rotates faster than the electrostatic latent image bearing member, which causes strong rubbing stress.

The toner is allowed to rub against the electrostatic latent image bearing member by the action of the rubbing stress. Therefore, the toner is strongly adhered to the electrostatic latent image bearing member, which deteriorates cleanability. Additionally, the electrostatic latent image bearing member is finely scratched, and then toner components are adhered to the scratched portions, which causes contamination of the electrostatic latent image bearing member. These are problematic.

As for a fixing system, there has been proposed to employ an oilless fixing system to thereby prevent high temperature offset due to a releasing agent and ensure releasability from paper. However, this proposition is problematic in that the releasing agent causes contamination of the electrostatic latent image bearing member.

To solve the above problems, there has been proposed to specify an amount of a releasing agent present on a toner surface to thereby reduce contamination of an electrostatic latent image bearing member (see Japanese Patent Application Laid-Open (JP-A) No. 2011-133518). However, in this proposition, a relatively large amount of the releasing agent is present on the toner surface, and the relationship between the electrostatic latent image bearing member and a toner bearing member is not taken into account. Therefore, when used in the contact type one-component developing, the proposition is unsatisfactory to prevent contamination of the electrostatic latent image bearing member.

There has been proposed to specify a property of a binder resin contained in a toner, and pressure between an electrostatic latent image bearing member and a toner bearing member to thereby reduce contamination of the electrostatic latent image bearing member (see JP-A No. 2002-214835). Also, there has been proposed to specify the type of a releasing agent used in a toner, and pressure between an electrostatic latent image bearing member and a toner bearing member to thereby reduce contamination of the electrostatic latent image bearing member (see JP-A No. 2003-035968).

However, in the above propositions, the amount of the releasing agent present on the toner surface, which is a cause of contamination of the electrostatic latent image bearing member, is not controlled, and measures are not taken to improve image quality. Therefore, this proposition is problematic in that the contamination of the electrostatic latent image bearing member is insufficiently prevented and high quality image cannot be obtained.

There has been proposed to specify the amount of a releasing agent present on a toner surface to thereby prevent the releasing agent from adhering to an electrostatic latent image bearing member (see JP-A No. 2003-207925). However, in the contact type one-component developing, the adhesion occurs greatly depending on contact pressure (developing pressure) between the electrostatic latent image bearing member and a toner bearing member. Therefore, this proposition is problematic in that the contamination of the electrostatic latent image bearing member is insufficiently prevented and high quality image cannot be obtained.

SUMMARY OF THE INVENTION

The present invention solves the above existing problems and aims to achieve the following objects. That is, the present invention aims to provide an image forming apparatus which is excellent in high temperature offset resistance, which can prevent contamination of an electrostatic latent image bearing member and occurrence of a white void at an image end portion over a long period of time, and which is excellent in image graininess, even when using a toner containing a releasing agent in a large amount in order to deal with a problem relating to a small sized toner.

Means for solving the above existing problems are as follows.

That is, the present invention provides an image forming apparatus, including:

an electrostatic latent image bearing member;

an electrostatic latent image forming unit configured to form an electrostatic latent image on the electrostatic latent image bearing member; and a developing unit containing a toner and configured to develop the electrostatic latent image with the toner to thereby form a visible image, wherein the developing unit is a contact type one-component developing unit which includes a toner bearing member being in contact with the electrostatic latent image bearing member, wherein a contact pressure between the electrostatic latent image bearing member and the toner bearing member is $2.0\times10^4$ N/m$^2$ to $7.5\times10^4$ N/m$^2$, wherein the toner contains a binder resin and a releasing agent, and wherein an extracted amount of the releasing agent extracted with hexane from the toner is 10 mg/g to 25 mg/g.

According to the present invention, the above existing problems can be solved to achieve the above objects. That is, the present invention can provide an image forming apparatus which is excellent in high temperature offset resistance, which can prevent contamination of an electrostatic latent image bearing member and occurrence of a white void at an image end portion over a long period of time, and which is excellent in image graininess, even when using a toner containing a releasing agent in a large amount in order to deal with a problem relating to a small sized toner.

Figure 1:
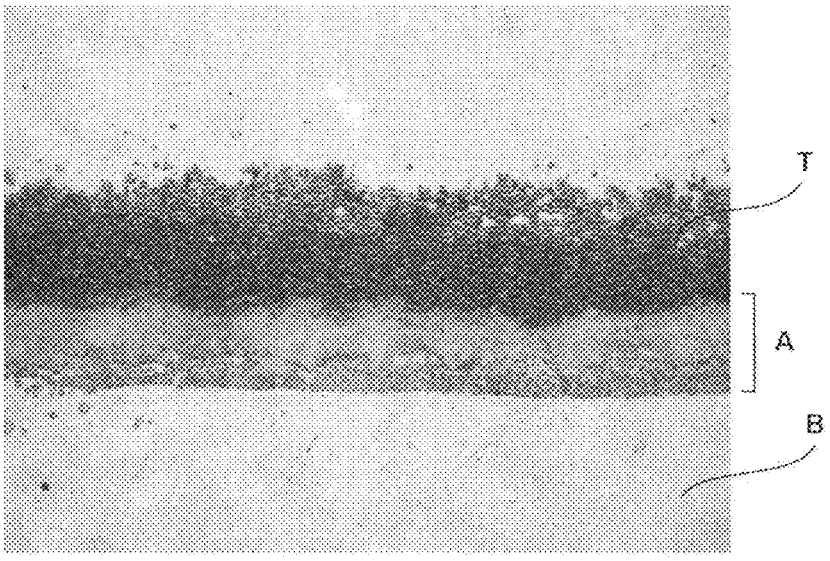
FIG. 1 is a photograph of one exemplary portion in proximity to a cleaning blade after image formation with a toner of the present invention.

DETAILED DESCRIPTION OF THE INVENTION (Image Forming Apparatus and Image Forming Method)

An image forming apparatus of the present invention includes at least an electrostatic latent image bearing member (hereinafter may be referred to as "photoconductor"), an electrostatic latent image forming unit, and a developing unit; preferably includes a deteriorated toner removing unit; and, if necessary, further includes other units.

An image forming method of the present invention includes at least an electrostatic latent image forming step, and a developing step; preferably includes a deteriorated toner removing step; and, if necessary, further includes other steps.

The image forming method can be suitably performed by the image forming apparatus. The electrostatic latent image forming step can be suitably performed by the electrostatic latent image forming unit. The developing unit can be suitably performed by the developing step. The deteriorated toner removing step can be suitably performed by the deteriorated toner removing unit. The other steps can be suitably performed by the other units.

In the image forming apparatus, the developing unit is a contact type one-component developing unit which includes a toner bearing member being in contact with the electrostatic latent image bearing member; and a contact pressure between the electrostatic latent image bearing member and the toner bearing member is $2.0\times10^4$ N/m$^2$ to $7.5\times10^4$ N/m$^2$.

In the image forming method, the developing step is a contact type one-component developing step which uses a toner bearing member being in contact with the electrostatic latent image bearing member; and a contact pressure between the electrostatic latent image bearing member and the toner bearing member is $2.0\times10^4$ N/m$^2$ to $7.5\times10^4$ N/m$^2$.

The image forming apparatus and the image forming method use a toner which contains at least a binder resin and a releasing agent, and in which an extracted amount of the releasing agent extracted with hexane from the toner is 10 mg/g to 25 mg/g.

<Toner>

The toner contains at least a binder resin and a releasing agent; and, if necessary, further contains other ingredients such as a colorant, a releasing agent dispersant, and an external additive.

In the toner, an extracted amount of the releasing agent extracted with hexane from the toner is 10 mg/g to 25 mg/g.

<<Binder Resin>>

The binder resin is not particularly limited and may be appropriately selected depending on the intended purpose, but a polyester resin is suitably used.

The polyester resin is not particularly limited and may be appropriately selected depending on the intended purpose. Examples of the polyester resin include ring-opening polymers of lactones, polycondensates of hydroxycarboxylic acids, and polycondensates of polyols (1) and polycarboxylic acids (2). Of these, polycondensates of polyols (1) and polycarboxylic acids (2) are preferred since a wide variety of polyesters can be formed.

A peak top molecular weight (Mp) of the polyester resin is not particularly limited and may be appropriately selected depending on the intended purpose. It is generally 1,000 to 30,000, preferably 1,500 to 10,000, further preferably 2,000 to 8,000. When the peak top molecular weight is 1,000 or more, the resultant toner is excellent in heat-resistant storageability. When the peak top molecular weight is 30,000 or less, the resultant toner is excellent in low-temperature fixability.

Herein, the peak top molecular weight can be measured by a conventional GPC (gel permeation chromatography).

The glass transition temperature of the polyester resin is not particularly limited and may be appropriately selected depending on the intended purpose. It is preferably 35° C. to 80° C., more preferably 40° C. to 70° C., further preferably 45° C. to 65° C. When the glass transition temperature is 35° C. or more, the resultant toner does not deform under high-temperature conditions such as in midsummer, or the resultant toner does not adhere to each other whereby they can behave as particles. When the glass transition temperature is 80° C. or less, the resultant toner is excellent in fixability.

—Glass Transition Temperature—

The glass transition temperature of a polyester resin or vinyl-based copolymer resin to be used can be measured by using, for example, a differential scanning calorimeter (e.g., DSC-6220R, product of Seiko Instruments Inc.) as follows. A sample is heated from room temperature to 150° C. at a temperature rising rate of 10° C./min; left to stand at 150° C. for 10 min; cooled to room temperature; left to stand at room temperature for 10 min; and then heated again to 150° C. at a temperature rising rate of 10° C./min. In the resultant DSC curve, the glass transition temperature is determined from the base line at a temperature equal to or lower than the glass transition temperature and a curved line portion in which the height of the base line is equal to half thereof at a temperature equal to or higher than the glass transition temperature.

The endothermic amounts and melting points of the releasing agent and a crystalline resin can be measured in the same manner. The endothermic amount is determined by calculating a peak area from a measured endothermic peak. Generally, the releasing agent contained in the toner melts at the temperature lower than the fixing temperature of the toner. When the releasing agent melts, the heat of melting is generated and it appears as the endothermic peak. In some releasing agents, the heat of transition due to phase transition in the solid phase thereof may be generated in addition to the heat of melting. In the present invention, the sum of the heat of transition and the heat of melting is determined as the endothermic amount of the heat of melting.

<<Polyol>>

Examples of the polyols (1) include diols and trihydric or higher polyols.

The diols are not particularly limited and may be appropriately selected depending on the intended purpose. Examples thereof include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexanedimethanol and hydrogenated bisphenol A); bisphenols (e.g., bisphenol A, bisphenol F and bisphenol S); 4,4'-dihydroxybiphenyls such as 3,3'-difluoro-4,4'-dihydroxybiphenyl; bis(hydroxyphenyl) alkanes such as bis(3-fluoro-4-hydroxyphenyl)methane, 1-phenyl-1,1-bis(3-fluoro-4-hydroxyphenyl)ethane, 2,2-bis (3-fluoro-4-hydroxyphenyl)propane, 2,2-bis(3,5-difluoro-4-hydroxyphenyl)propane (herein may be referred to as tetrafluorobisphenol A) and 2,2-bis(3-hydroxyphenyl)-1,1,1,3,3,3-hexafluoropropane; bis(4-hydroxyphenyl)ethers such as bis(3-fluoro-4-hydroxyphenyl)ether; adducts of the above-listed alicyclic diols with alkylene oxides (e.g., ethylene oxide, propylene oxide and butylene oxide); and adducts of the above-listed bisphenols with alkylene oxides (e.g., ethylene oxide, propylene oxide and butylene oxide). These may be used alone or in combination.

Examples of the trihydric or higher polyols include trihydric or higher aliphatic polyalcohols (e.g., glycerin, trimethylolethane, trimethylolpropane, pentaerythritol and sorbitol); trihydric or higher phenols (e.g., trisphenol PA, phenol novolac and cresol novolac); and alkylene oxide adducts of the above-listed trihydric or higher polyphenols.

Of these, preferred are C2 to C12 alkylene glycols and alkylene oxide adducts of bisphenols. More preferred are alkylene oxide adducts of bisphenols, and combinations of alkylene oxide adducts of bisphenols with C2 to C12 alkylene glycols.

<<<Polycarboxylic Acid>>>

Examples of polycarboxylic acids (2) include dicarboxylic acids and trivalent or higher polycarboxylic acids.

The dicarboxylic acids are not particularly limited and may be appropriately selected depending on the intended purpose. Examples thereof include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acid), 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid and hexafluoroisopropylidene diphthalic anhydride. These may be used alone or in combination.

Examples of trivalent or higher polycarboxylic acids include C9 to C20 aromatic polycarboxylic acids (e.g., trimellitic acid and pyromellitic acid), and acid anhydrides or lower alkyl esters (e.g., methyl ester, ethyl ester and isopropyl ester) of the above-listed carboxylic acids.

Of these, preferred are C4 to C20 alkenylenedicarboxylic acids and C8 to C20 aromatic dicarboxylic acids.

—Ratio of Polyol to Polycarboxylic Acid—

The ratio of the polyol (1) to the polycarboxylic acid (2) is generally 2/1 to 1/1, preferably 1.5/1 to 1/1, further preferably 1.3/1 to 1.02/1, in terms of the equivalent ratio [OH]/[COOH] of the hydroxyl group [OH] to the carboxyl group [COOH].

<<Modified Polyester Resin>>

The binder resin may contain a modified polyester resin containing a urethane and/or urea group (hereinafter may be referred to as "modified polyester resin") for adjusting the viscoelasticity. An amount of the modified polyester resin contained in the binder resin is preferably 20% by mass or less, more preferably 15% by mass or less, further preferably 10% by mass or less. When the amount is more than 20% by mass, the resultant toner may be deteriorated in low-temperature fixability. The modified polyester resin may be directly mixed with the binder resin, but it is preferred from the viewpoint of productivity that a relatively low molecular weight modified polyester resin containing a terminal isocyanate group (hereinafter may be referred to as "prepolymer") and a chain elongating and/or cross linking agent reactive therewith (e.g., amines) be mixed with the binder resin, and be allowed to undergo a chain elongation and/or cross linking reaction during and/or after granulation to thereby form the modified polyester resin containing a urethane and/or urea group. In this manner, the modified polyester resin having a relatively high molecular weight for adjusting the viscoelasticity can be easily added to the binder resin.

<<<Prepolymer>>>

Examples of the prepolymer include a reaction product between a polyisocyanate (3) and an active hydrogen group-containing polyester, which is a polycondensate between the polyol (1) and the polycarboxylic acid (2). Examples of the active hydrogen group contained in the polyester include a hydroxyl group (an alcoholic hydroxyl group or phenolic hydroxyl group), an amino group, a carboxyl group and a mercapto group. Of these, an alcoholic hydroxyl group is preferred.

Examples of the polyisocyanate (3) include aliphatic polyisocyanates (e.g., tetramethylene diisocyanate, hexamethylene diisocyanate and 2,6-diisocyanatomethylcaproate); alicyclic polyisocyanates (e.g., isophorone diisocyanate and cyclohexylmethane diisocyanate); aromatic diisocyanates (e.g., tolylene diisocyanate and diphenylmethane diisocyanate); aroma-aliphatic diisocyanates (e.g., α, α, α', α'-tetramethylxylylene diisocyanate); isocyanurates; products obtained by blocking the above-listed polyisocyanates with, for example, a phenol derivative, oxime or caprolactam; and combinations thereof.

—Ratio of Isocyanate Group to Hydroxyl Group—

The equivalent ratio [NCO]/[OH] of the isocyanate group [NCO] of the polyisocyanate (3) to the hydroxyl group [OH] of the hydroxyl group-containing polyester is generally 5/1 to 1/1, preferably 4/1 to 1.2/1, further preferably 2.5/1 to 1.5/1. When the equivalent ratio [NCO]/[OH] exceeds 5, the resultant toner may be deteriorated in low-temperature fixability. When the equivalent ratio [NCO]/[OH] is less than 1, the urea content in the modified polyester may decrease and the resultant toner may be deteriorated in hot-offset resistance.

The amount of the polyisocyanate (3) component contained in the prepolymer is generally 0.5% by mass to 40% by mass, preferably 1% by mass to 30% by mass, further preferably 2% by mass to 20% by mass. When the amount is less than 0.5% by mass, the resultant toner may be deteriorated in hot-offset resistance. When the amount is more than 40% by mass, the resultant toner may be deteriorated in low-temperature fixability.

—Number of Isocyanate Group in Prepolymer—

The prepolymer generally has, per one molecule thereof, one or more isocyanate groups, preferably 1.5 to 3 isocyanate groups on average, more preferably 1.8 to 2.5 isocyanate groups on average. When the prepolymer has less than 1 isocyanate group per one molecule thereof, the modified polyester which has undergone the chain elongation and/or cross-linking reaction is decreased in molecular weight, which may deteriorate offset resistance of the resultant toner.

<<<Chain Elongating and/or Cross-Linking Agent>>>

Amines (B) can be used as the chain elongating and/or cross-linking agent.

The amines (B) are not particularly limited and may be appropriately selected depending on the intended purpose. Examples thereof include diamines (B1), trivalent or higher polyamines (B2), aminoalcohols (B3), aminomercaptans (B4), amino acids (B5) and amino-blocked compounds (B6) obtained by blocking the amino group of (B1) to (B5).

These may be used alone or in combination. Of these, particularly preferred are diamine (B1), and a mixture of diamine (B1) with a small amount of trivalent or higher polyamine (B2).

Examples of the diamine (B1) include aromatic diamines, alicyclic diamines, and aliphatic diamines. Examples of the aromatic diamines include phenylene diamine, diethyltoluene diamine, and 4,4'-diaminodiphenylmethane. Examples of the alicyclic diamines include 4,4'-diamino-3,3'-dimethyldicyclohexylmethane, diaminecyclohexane and isophoronediamine. Examples of the aliphatic diamines include ethylenediamine, tetramethylenediamine, and hexamethylenediamine.

Examples of the trivalent or higher polyamine (B2) include diethylenetriamine and triethylenetetramine.

Examples of the aminoalcohol (B3) include ethanolamine and hydroxyethylaniline.

Examples of the aminomercaptan (B4) include aminoethylmercaptan and aminopropylmercaptan.

Examples of the amino acid (B5) include aminopropionic acid and aminocaproic acid.

Examples of the amino-blocked compound (B6) obtained by blocking the amino group of (B1) to (B5) include oxazolidine compounds and ketimine compounds derived from any of the amines (B1) to (B5) and ketones (e.g., acetone, methyl ethyl ketone and methyl isobutyl ketone).

<<<Reaction Terminator>>>

Notably, a reaction terminator can be used to terminate the elongation and/or crosslinking reaction between the active hydrogen group-containing compound and the modified polyester reactive with the active hydrogen group-containing compound. The reaction terminator is preferred in that it can adjust the molecular weight of the adhesive base to a desired range. Examples of the reaction terminator include monoamines (e.g., diethyl amine, dibutyl amine, butyl amine and lauryl amine) and blocked products thereof (e.g., ketimine compounds).

—Ratio of Amino Group to Isocyanate Group—

A mixing ratio of the amines (B) to the prepolymer is preferably 1/3 to 3/1, more preferably 1/2 to 2/1, particularly preferably 1/1.5 to 1.5/1, in terms of a mixing equivalent ratio ([NCO]/[NHx]) of the isocyanate group [NCO] of the prepolymer (A) to the amino group [NHx] of the amines (B).

When the mixing equivalent ratio ([NCO]/[NHx]) is less than 1/3, the resultant toner may be deteriorated in low-temperature fixability. When the mixing equivalent ratio ([NCO]/[NHx]) is more than 3/1, the modified polyester may be decreased in molecular weight, which may deteriorate hot-offset resistance of the resultant toner.

<<<Crystalline Polyester Resin>>>

The binder resin may contain a crystalline polyester resin for improving low-temperature fixability.

The crystalline polyester resin is obtained as the polycondensate between the polyol and the polycarboxylic acid as described above.

The polyol is preferably an aliphatic diol. Specific examples thereof include ethylene glycol, 1,2-propylene glycol, 1,3-propylene glycol, 1,4-butanediol, 1,5-pentanediol, 1,6-hexanediol, 1,7-heptanediol, 1,8-octanediol, neopentyl glycol, and 1,4-butenediol. Of these, 1,4-butanediol, 1,6-hexanediol, and 1,8-octanediol are preferred, and 1,6-hexanediol is further preferred.

The polycarboxylic acid is preferably an aromatic dicarboxylic acid (e.g., phthalic acid, isophthalic acid, and terephthalic acid) or a C2-C8 aliphatic carboxylic acid. Of these, aliphatic carboxylic acid is more preferred for increasing the degree of crystallinity.

Notably, the crystalline resin (e.g., crystalline polyester) and the non-crystalline resin are distinguished from each other based on the thermal properties thereof. The crystalline resin refers to, for example, a resin having a clear endothermic peak in a DSC measurement, such as the releasing agent. The non-crystalline resin refers to a resin exhibiting a gentle curve based on a glass transition in a DSC measurement.

<<Releasing Agent>>

Examples of the releasing agent include polyolefin waxes (e.g., polyethylene wax and polypropylene wax); long-chain hydrocarbons (e.g., paraffin waxes, Fischer-Tropsch waxes and SASOL wax); and carbonyl group-containing waxes.

Examples of the carbonyl group-containing wax include polyalkanoic acid esters (e.g., carnauba wax, montan wax, trimethylolpropane tribehenate, pentaerythritol tetrabehenate, pentaerythritol diacetatedibehenate, glycerine tribehenate and 1,18-octadecanediol distearate); polyalkanol esters (e.g., tristearyl trimellitate and distearyl maleate); polyalkanoic acid amides (e.g., ethylenediamine dibehenylamide); polyalkylamides (e.g., tristearylamide trimellitate); dialkyl ketones (e.g., distearyl ketone); and synthetic ester waxes (e.g., mono- or di-ester based waxes).

Of these, paraffin waxes or synthetic ester waxes (e.g., mono- or di-ester based waxes) are preferred.

The melting point of the releasing agent is not particularly limited and may be appropriately selected depending on the intended purpose. It is preferably 60° C. to 95° C., more preferably 70° C. to 88° C. from the viewpoints of storageability and volatility.

When the melting point is less than 60° C., toner blocking may be easily caused during storage, which may deteriorate heat-resistant storageability. In addition, more releasing agent may be volatilized to thereby deteriorate contamination resistance in a developing device. When the melting point is more than 100° C., the resultant toner may be deteriorated in low-temperature fixability. In addition, the resultant toner may have reduced affinity with an organic solvent to thereby prevent the releasing agent from being finely dispersed.

Herein, the melting point refers to a transparent melting point, i.e., the temperature at which a finely pulverized releasing agent turns completely transparent, when the finely pulverized releasing agent is placed in a capillary tube, one end of which is closed, and then increased in temperature at a constant rate to be allowed to melt. The transparent melting point can be measured according to "The JOCS Standard Methods for the Analysis of Fats, Oils and Related Materials (2.2.4.1-1996)" established by Japan Oil Chemists' Society.

The synthetic ester wax can be obtained through a dehydration-condensation between a linear fatty acid and a monohydric higher alcohol or a polyhydric alcohol.

The linear fatty acid is not particularly limited and may be appropriately selected depending on the intended purpose. Examples thereof include myristic acid, palmitic acid, stearic acid, arachidic acid, behenic acid and lignoceric acid.

The monohydric higher alcohol is not particularly limited and may be appropriately selected depending on the intended purpose. Examples thereof include capryl alcohol, capric alcohol, lauryl alcohol, myristyl alcohol, cetyl alcohol, stearyl alcohol, arachidyl alcohol, behenyl alcohol and lignoceryl alcohol.

The polyhydric alcohol is not particularly limited and may be appropriately selected depending on the intended purpose. Examples thereof include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanethiol, 2-methyl-1,2,4-butanetriol, trimethylolethane, trimethylolpropane and 1,3,5-trihydroxybenzene.

A monoester synthesized from the linear fatty acid and the monohydric alcohol has preferably 30 to 50 carbon atoms from the viewpoint of compatibility with a hydrocarbon-based releasing agent.

A saturated ester synthesized from the linear fatty acid and the polyhydric alcohol has preferably 15 or more carbon atoms from the similar viewpoint.

The synthetic ester wax preferably consists of the monoester and the saturated ester from the viewpoints of fixability, releasability, and storage ability.

—Extracted Amount of Releasing Agent—

In the toner, an extracted amount of the releasing agent extracted with hexane from the toner is not particularly limited and may be appropriately selected depending on the intended purpose, as long as it is 10 mg/g to 25 mg/g. It is preferably 12 mg/g to 23 mg/g, more preferably 15 mg/g to 23 mg/g. The extracted amount is less than 10 mg/g, releasability during fixing may be insufficient. The extracted amount is more than 25 mg/g, a member in a developing device may be contaminated or the resultant toner may be decreased in circularity due to the presence of a releasing agent thereon. The extracted amount of 15 mg/g to 23 mg/g is advantageous in fixability and contamination resistance of various members.

Herein, the "extracted amount of the releasing agent extracted with hexane from the toner" means an extracted amount of the releasing agent measured according to the following method.

Specifically, 1.0 g of a toner is weighed, and 7 mL of n-hexane is added thereto. The resultant is stirred with a roll mill at 120 rpm for 1 min at 23° C. to thereby obtain a solution. Then, the resultant solution is subjected to suction filtration and vacuum drying to thereby remove n-hexane. The resultant residue is weighed in mg, which is determined as the extracted amount of the releasing agent (mg per 1 g of toner; herein may be referred to as mg/g for convenience).

<<Other Ingredients>>

<<<Colorant>>>

The colorant is not particularly limited and may be appropriately selected depending on the intended purpose. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G and R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloro-orthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmin 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS and BC), indigo, ultramarine, iron blue, anthraquinone blue, fast violet B, methylviolet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinon green, titanium oxide, zinc flower, and lithopone. These may be used alone or in combination.

An amount of the colorant is not particularly limited and may be appropriately selected depending on the intended purpose. It is generally 1% by mass to 15% by mass, preferably 3% by mass to 10% by mass relative to that of the toner.

<<<Releasing Agent Dispersant>>>

The toner may contain a releasing agent dispersant as the other ingredients.

When the toner contains the releasing agent dispersant, the releasing agent is satisfactory dispersed into the binder resin. In addition, the dispersed state of the releasing agent and the extracted amount of the releasing agent extracted with hexane from the toner can be easily controlled by adjusting the amounts of the releasing agent and the releasing agent dispersant.

When the toner contains 50% by mass to 100% by mass of the polyester resin serving as the binder resin, the polyester resin is hardly compatible with the releasing agent.

In this case, unless the releasing agent dispersant is used, the releasing agent may be discharged to the aqueous medium without introduced into toner particles during toner production. Alternatively, the releasing agent may be migrated from the inside to the surface of the toner particle to thereby be exposed on the surface, so that the amount of the releasing agent present on the surface of toner particle increases, which may cause contamination of other members.

Accordingly, the toner preferably contains the releasing agent dispersant.

The releasing agent dispersant is not particularly limited and may be appropriately selected depending on the intended purpose, but it is preferably a graft polymer having a structure in which a below-described resin (B) is grafted as a side chain onto a below-described resin (A) serving as a backbone.

The resin (A) may be selected from known resins, as long as the resin (B) can be grafted thereonto. Example thereof includes a polyolefin resin. Especially, a thermally degradable polyolefin resin is preferred.

Examples of olefins constituting the polyolefin resin include ethylene, propylene, 1-butene, isobutylene, 1-hexene, 1-dodecene, and 1-octadecene.

Examples of the polyolefin resin include polymers of olefins; oxides of polymers of olefins; modified products of polymers of olefins; and copolymers of olefins and other monomers copolymerizable with the olefins.

Examples of the polymers of olefins include polyethylene, polypropylene, an ethylene/propylene copolymer, an ethylene/1-butene copolymer, and a propylene/1-hexene copolymer.

Examples of the oxides of polymers of olefins include oxides of the above-listed polymer of olefins.

Examples of the modified products of polymers of olefins include maleic acid derivative (e.g. maleic anhydride, monomethyl maleate, monobutyl maleate, and dimethyl maleate) adducts of the above-listed polymers of olefins.

Examples of the copolymers of olefins and other monomers copolymerizable with the olefins include copolymers of olefins and monomers such as unsaturated carboxylic acids (e.g., (meth)acrylic acid, itaconic acid, and maleic anhydride) and unsaturated carboxylic acid alkyl esters (e.g., alkyl (C1 to C18) ester(meth)acrylate, and alkyl (C1 to C18) ester maleate).

The polyolefin may be any polymer as long as the polymer structure thereof includes a polyolefin structure, and monomers constituting the polyolefin do not necessarily include an olefin structure. For example, polymethylene (e.g. Sasol wax) can be used.

Among the above-listed polyolefin resins, the polymers of olefins, oxides of polymers of olefins, and modified products of polymers of olefins are preferred; polyethylene, polymethylene, polypropylene, ethylene/propylene copolymer, oxidized polyethylene, oxidized polypropylene, and maleic polypropylene are more preferred; and polyethylene and polypropylene are further preferred.

Examples of the monomer constituting the resin (B) include an alkyl (C1 to C5) ester of unsaturated carboxylic acids [e.g., methyl(meth)acrylate, ethyl(meth)acrylate, butyl (meth)acrylate, and 2-ethylhexyl(meth)acrylate], and vinyl ester-based monomers (e.g., vinyl acetate).

Of these, alkyl(meth)acrylate is preferred, and C1 to C5 alkyl(meth)acrylate (E1) is more preferred.

Examples of an aromatic vinyl monomer (E2) used in combination with the (E1) as the monomers constituting the resin (B) include styrene-based monomers [e.g., styrene, α-methyl styrene, p-methyl styrene, m-methyl styrene, p-methoxy styrene, p-hydroxy styrene, p-acetoxy styrene, vinyl toluene, ethyl styrene, phenyl styrene, and benzyl styrene].

Of these, styrene is preferred.

The mass ratio (A)/(B) of the resin (A) constituting a backbone of the releasing agent dispersant to the resin (B) constituting a side chain of the releasing agent dispersant is preferably 1 to 50. When the mass ratio is higher than 50, the releasing agent dispersant is poorly compatible with the binder resin. When the mass ratio is lower than 1, the releasing agent dispersant may not have sufficient compatibility with the releasing agent added, which may cause poor dispersion of the releasing agent.

An amount of the releasing agent dispersant relative to that of the releasing agent is preferably 55% by mass to 130% by mass, more preferably 60% by mass to 120% by mass.

The glass transition temperature of the releasing agent dispersant is preferably 55° C. to 80° C., more preferably 55° C. to 70° C. When the glass transition temperature is higher than 80° C., the resultant toner may be deteriorated in low-temperature fixability. When the glass transition temperature is lower than 55° C., the resultant toner may be deteriorated in hot-offset resistance.

<<<External Additive>>>

The external additive is not particularly limited and may be appropriately selected depending on the intended purpose. Examples thereof include inorganic particles (for example, non-surface-treated inorganic particles, inorganic particles surface-treated with a surface treating agent, and inorganic particles surface-treated with a hydrophobizing agent).

Examples of the inorganic particles include silica, alumina, titania, barium titanate, magnesium titanate, calcium titanate, strontium titanate, iron oxide, copper oxide, zinc oxide, tin oxide, silica sand, clay, mica, wollastonite, diatom earth, chromium oxide, cerium oxide, red oxide, antimony trioxide, magnesium oxide, zirconium oxide, barium sulfate, calcium carbonate, barium carbonate, silicon carbide and silicon nitride. Of these, silica, titania and alumina are preferred. These may be used alone or in combination.

An amount of the external additive is not particularly limited and may be appropriately selected depending on the intended purpose. It is preferably 0.1% by mass to 5% by mass, more preferably 0.3% by mass to 4.5% by mass relative to that of the toner.

The inorganic particles are preferably the inorganic particles surface-treated with a surface treating agent.

Examples of the surface treating agent include silane coupling agents, silylation agents, silane coupling agents having a fluorinated alkyl group, organotitanate-based coupling agents, aluminum-based coupling agents, silicone oillvarnish. Of these, silicone oil is preferred from the viewpoint of cleanability of the spherical toner.

The external additive is preferably silica, titania, or alumina each of which is surface-treated with silicone oil because they function as a cleaning aid by decreasing rubbing force at a cleaning portion; and more preferably silica which is surface-treated with silicone oil because it has higher resistance than titania and alumina, so that the resultant toner does not decrease in chargeability.

Examples of the silicone oil include dimethyl silicone oils, methylphenyl silicone oils, chlorophenyl silicone oils, methylhydrogen silicone oils, alkyl-modified silicone oils, fluorine-modified silicone oils, polyether-modified silicone oils, alcohol-modified silicone oils, amino-modified silicone oils, epoxy-modified silicone oils, epoxy/polyether-modified silicone oils, phenol-modified silicone oils, carboxyl-modified silicone oils, mercapto-modified silicone oils, acryl-modified silicone oils, methacryl-modified silicone oils and α-methylstyrene-modified silicone oils.

The number average particle diameter of primary particles of the inorganic particles surface-treated with silicone oil is not particularly limited and may be appropriately selected depending on the intended purpose. It is preferably 30 nm to 150 nm, more preferably 30 nm to 100 nm.

When the number average particle diameter is larger than 150 nm, the inorganic particles are decreased in surface area, so that the total amount of the silicone oil carried on the inorganic particles becomes small, and, therefore, the silicone oil is difficult to sufficiently exhibit their effects. When the number average particle diameter is smaller than 30 nm, the inorganic particles are hardly exfoliated from the toner particles, so that a stopper layer necessary for cleaning is difficult to be formed. Therefore, excellent cleanability may not be easily exhibited. The number average particle diameter of 30 nm to 150 nm is preferred in that the stopper layer is formed in a system employing a cleaning blade to thereby ensure good cleanability.

The BET specific surface area of the inorganic particles surface-treated with silicone oil is not particularly limited and may be appropriately selected depending on the intended purpose, but it is preferably 10 $m^2/g$ to 50 $m^2/g$.

When the BET specific surface area is smaller than 10 $m^2/g$, the total amount of the silicone oil carried on the inorganic particles becomes small, and therefore excellent cleanability may not be easily exhibited. When the BET specific surface area is larger than 50 $m^2/g$, a stopper layer necessary for cleaning is difficult to be formed, and, therefore, excellent cleanability may not be easily exhibited.

—BET Specific Surface Area—

Herein, the BET specific surface area of the external additive is measured in the following manner using a surface area analyzer AUTOSORB-1 (product of Quantachrome Instruments).

About 0.1 g of a measurement sample is weighed in a cell, and degassed at the temperature of 40° C. and the degree of vacuum of $1.0\times10^{-3}$ mmHg or lower for 12 hours or longer.

Thereafter, nitrogen gas is allowed to be adsorbed on the sample while cooling by liquid nitrogen, and the value of the BET specific surface area is measured by a multi-point method.

An amount of silicone oil used for surface-treating relative to that of the inorganic particles surface-treated with silicone oil serving as the external additive is not particularly limited and may be appropriately selected depending on the intended purpose. It is preferably 2 $mg/m^2$ surface area of the external additive to 10 $mg/m^2$ surface area of the external additive.

When the amount is less than 2 $mg/m^2$, a stopper layer necessary for cleaning is difficult to be formed, and, therefore, excellent cleanability may not be easily exhibited. When the amount is more than 10 $m^2/g$, the amount of free silicone oil becomes too much to cause contamination of various members.

—Free Silicone Oil—

Herein, the term "free silicone oil" refers to silicone oil which is freed from the inorganic particles surface-treated with silicone oil. A ratio of the mass of the silicone oil which is freed from the inorganic particles to that of the toner as measured by the following method is determined as a total free silicone oil amount (% by mass). The free silicone oil has not necessarily chemically bonded to surfaces of the inorganic particles, and includes silicone oil which has physically adsorbed on pores on surfaces of the inorganic particles. More specifically, the free silicone oil means silicone oil which is easily detached from the inorganic particles by the action of contact force.

—Measurement of Total Free Silicone Oil Amount—

The total free silicone oil amount (amount of free silicone oil) in the toner is measured by a quantitative method including the following steps (1) to (3):

(1) Extraction of Free Silicone Oil

A sample toner is immersed in chloroform, stirred, and left to stand. A supernatant is removed by centrifugal separation to thereby obtain a solid content. Chloroform is added to the solid content, and the resultant is stirred, and left to stand.

The above procedures are repeated to remove free silicone oil from the sample.

(2) Quantification of Carbon Content

The carbon content in the sample from which the free silicone oil had been removed is quantified by CHN elemental analyzer (CHN CORDER MT-5; product of Yanaco Technical Science Co., Ltd.).

(3) Quantification of Total Free Silicone Oil Amount

The total free silicone oil amount is calculated by the following Equation (1).

$$\text{Total free silicone oil amount}=(C0-C1)/C\times100\times37/12(\%\text{ by mass}) \quad \text{Equation (1)}$$

In the above equation,

"C" denotes a carbon content (% by mass) in the silicone oil serving as the treating agent, "C0" denotes a carbon content (% by mass) in the sample before the extraction, "C1" denotes a carbon content (% by mass) in the sample after the extraction, and the coefficient "37/12" denotes the conversion factor for converting the C (carbon) amount in a structure of polydimethylsiloxane to the total amount.

The structural formula of polydimethylsiloxane is presented below:

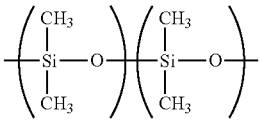

PMDS: polydimethylsiloxane

The total free silicone oil amount relative to the amount of the toner is not particularly limited and may be appropriately selected depending on the intended purpose. It is preferably 0.2% by mass to 0.5% by mass, more preferably 0.3% by mass to 0.5% by mass, particularly preferably 0.3% by mass to 0.4% by mass.

When the total free silicone oil amount is smaller than 0.2% by mass, cleanability may be deteriorated, and an abrasion amount of a surface of the electrostatic latent image bearing member may increase. When the total free silicone oil amount is larger than 0.5% by mass, a member may be contaminated during developing, for example, a regulating blade used in the one-component developing may be contaminated. In addition, after durable printing, chargeability may be deteriorated due to the contamination so that the charge amount of the toner may be decreased.

A method for surface-treating the inorganic particles with a surface treating agent is not particularly limited and may be appropriately selected depending on the intended purpose. Example thereof includes the following methods.

Silicone oil is uniformly brought into contact with the inorganic particles, which have been previously sufficiently dehydrated and dried in an oven at the temperature of several hundred degrees Celsius, to thereby deposit it on surfaces of the inorganic particles.

Examples of a method for depositing the silicone oil on the inorganic particles include a method in which the inorganic particles are sufficiently mixed with and the silicone oil as powders by means of a mixer such as a rotating blade; and a method in which the silicone oil is dissolved in a solvent capable of diluting the silicone oil and having a relatively low boiling point, and then the inorganic particles are immersed in the resultant solution, followed by removing the solvent by drying.

In the case where the silicone oil has high viscosity, the inorganic particles are preferably treated in a liquid.

Thereafter, the inorganic particles on which the silicone oil has been deposited is subjected to a heat treatment in an oven at the temperature of 100° C. to several hundred degrees Celsius. As a result, the silicone oil can be bound to a metal through a siloxane bond using hydroxyl groups on surfaces of the inorganic particles, or the silicone oil itself can be further polymerized or cross-linked.

The silicone oil can be acceleratedly polymerized or cross-linked by adding a catalyst (e.g., acid, alkali, a metal salt, zinc octylate, tin octylate, and dibutyl tin dilaurate) to the silicone oil in advance.

Moreover, prior to the surface treatment with the silicone oil, the inorganic particles may be treated with a hydrophobizing agent, such as a silane coupling agent. The silicone oil is adsorbed on the inorganic particles which have been hydrophobized in advance in a larger amount than on unhydrophobized inorganic particles.

Effects of the free silicone oil in the present invention will be described.

FIG. 1 is a photograph of one exemplary portion in proximity to a cleaning blade after image formation with a toner of the present invention. The cleaning blade was removed, and a surface of the electrostatic latent image bearing member B was observed. At a portion which had been contact with the cleaning blade, a stopper layer A was formed of silica surface-treated with the silicone oil between the toner T and the cleaning blade. This stopper layer A prevents the toner T from passing-through the cleaning blade. Moreover, a certain amount of the free silicone oil provides reduced rubbing force between the electrostatic latent image bearing member B and the cleaning blade, and therefore surfaces of the electrostatic latent image bearing member can be prevented from being abraded.

As for the external additive, the inorganic particles surface-treated with the surface treating agent may be used together with one or more minute external additives such as inorganic particles which have not surface-treated and/or inorganic particles which have been surface-treated with a hydrophobizing agent other than the surface treating agent (e.g., silicone oil).

Examples of the hydrophobizing agent include silane coupling agents, silylation agents, silane coupling agents containing a fluorinated alkyl group, organotitanate-based coupling agents, and aluminum-based coupling agents.

As for the inorganic particles serving as the minute external additives to be used in combination with the external additive, inorganic particles having a smaller average particle diameter than that of the inorganic particles surface-treated with the surface treating agent are suitably used.

The inorganic particles having a smaller average particle diameter increase the coverage rate of the toner surface, which contributes to give appropriate flowability to a developer and to secure faithful reproducibility of a latent image or a developing amount during developing. Moreover, the resultant toner can be prevented from aggregating or solidifying during storage of a developer.

The minute external additives are added in an amount of preferably 0.01% by mass to 5% by mass, more preferably 0.1% by mass to 2% by mass, relative to that of the toner.

<<<Cleanability Improving Agent>>>

A cleanability improving agent may be used in combination for removing a developer remaining on an electrostatic latent image bearing member or primary transfer medium after transferring.

The cleanability improving agent is not particularly limited and may be appropriately selected depending on the intended purpose. Examples thereof include stearic acid, a metal salt of fatty acid (e.g., zinc stearate and calcium stearate), polymer particles made through, for example, soap-free emulsion polymerization (e.g., polymethyl methacrylate particles and polystyrene particles). The polymer particles preferably have a relatively narrow particle size distribution and the volume average particle diameter of 0.01 μm to 1 μm.

<<<Resin Particles>>>

In the present invention, resin particles, for example, particles formed of polystyrene obtained through soap-free emulsion polymerization, suspension polymerization, or dispersion polymerization; copolymers of methacrylic acid ester or acrylic acid ester; polycondensation products such as silicone, benzoguanamine, or nylon; or a thermosetting resin may be used in combination during external addition.

The resin particles enable to enhance chargeability of a developer, decrease the number of reversely charged toner particles, and reduce background smear.

An amount of the resin particles is not particularly limited and may be appropriately selected depending on the intended purpose. It is preferably 0.01% by mass to 5% by mass, more preferably 0.1% by mass to 2% by mass, relative to that of the toner.

<<<Resin Particles for Shell Layer>>>

The toner particles may include a core portion and a shell layer formed of the resin particles. Vinyl-based resin particles are suitably used as the resin particles for the shell layer.

Resin particles formed of the vinyl-based resin can be formed by polymerizing a monomer mixture containing mainly, as a monomer, a vinyl polymerizable functional group-containing aromatic compound.

An amount of the vinyl polymerizable functional group-containing aromatic compound contained in the monomer mixture is not particularly limited and may be appropriately selected depending on the intended purpose. It is preferably 80% by mass to 100% by mass, more preferably 80% by mass to 95% by mass, further preferably 80% by mass to 90% by mass. When the amount is less than 80% by mass, the resultant toner may have poor chargeability.

Examples of a polymerizable functional group in the vinyl polymerizable functional group-containing aromatic compound include a vinyl group, an isopropenyl group, an allyl group, an acryloyl group and a methacryloyl group.

Examples of the vinyl polymerizable functional group-containing aromatic compound include styrene, α-methylstyrene, 4-methylstyrene, 4-ethylstyrene, 4-tert-butylstyrene, 4-methoxystyrene, 4-ethoxystyrene, 4-carboxystyrene or a metal salt thereof, 4-styrenesulfonic acid or a metal salt thereof, 1-vinylnaphthalene, 2-vinylnaphthalene, allylbenzene, butyl acrylate, phenoxyalkylene glycol acrylate, phenoxyalkylene glycol methacrylate, phenoxypolyalkylene glycol acrylate, phenoxypolyalkylene glycol methacrylate and methoxydiethylene glycol methacrylate.

Of these, styrene or butyl acrylate is preferably used as a main component because it is easily available, and has excellent reactivity and high chargeability.

The vinyl-based resin particles may contain a compound containing a vinyl polymerizable functional group and an acid group (hereinafter may be referred to as "acid monomer") in an amount of 0% by mass to 7% by mass relative to that of the monomer mixture. The amount of the acid monomer is preferably 0% by mass to 4% by mass, more preferably 0% by mass (i.e., the acid monomer is not used). When the amount exceeds 7% by mass, the resultant vinyl-based resin particles themselves have high dispersion stability. Thus, when such vinyl-based resin particles are added to a dispersion liquid in which oil droplets are dispersed into an aqueous phase, they are difficult to attach thereonto at ambient temperature. Alternatively, even when the vinyl-based resin particles attach thereonto, they tend to be exfoliated through processes of desolvation, washing, drying and external addition. When the amount is 4% by mass or less, the resultant toner is not greatly changed in chargeability depending on a working environment, which is advantageous.

Examples of the acid group in the compound containing a vinyl polymerizable functional group and an acid group include carboxylic acid, sulfonic acid and phosphoric acid.

Examples of the compound containing a vinyl polymerizable functional group and an acid group include carboxyl group-containing vinyl monomers and salts thereof (e.g., (meth)acrylic acid, maleic acid or maleic anhydride, monoalkyl maleate, fumaric acid, monoalkyl fumarate, crotonic acid, itaconic acid, monoalkyl itaconate, glycol itaconate monoether, citraconic acid, monoalkyl citraconate and cinnamic acid); sulfonic acid group-containing vinyl monomers, vinyl-based sulfuric acid monoesters and salts thereof, and phosphoric acid group-containing vinyl monomers and salts thereof. Of these, preferred are (meth)acrylic acid, maleic acid or maleic anhydride, monoalkyl maleate, fumaric acid and monoalkyl fumarate.

In the case where the resin particles for the shell layer are highly compatible with a resin for the core portion, surfaces of the resultant toner particles cannot be in a desirable condition. Therefore, the monomer mixture and the resin for the core portion to be used are preferably controlled to have polarity or structure so as to reduce compatibility therebetween.

Preferably, the resin particles for the shell layer are not excessively dissolved in an organic solvent to be used. In the case where the resin particles for the shell layer are dissolved to the extent that the shape thereof cannot be kept, surfaces of the resultant toner particles cannot be in a desirable condition.

A method for obtaining the vinyl-based resin particles is not particularly limited. Examples thereof include the following methods (a) to (f):

(a) a method in which a monomer mixture is allowed to be polymerized through, for example, suspension polymerization, emulsion polymerization, seed polymerization or dispersion polymerization, to thereby produce a dispersion liquid of vinyl-based resin particles;

(b) a method in which a monomer mixture is allowed to be polymerized, and then the resultant resin is pulverized using a pulverizer (e.g., a mechanically rotating type pulverizer or a jet type pulverizer), followed by classifying, to thereby produce resin particles;

(c) a method in which a monomer mixture is allowed to be polymerized, and the resultant resin is then dissolved in a solvent, followed by spraying the resultant resin solution, to thereby produce resin particles;

(d) a method in which a monomer mixture is allowed to be polymerized, the resultant resin is dissolved in a solvent, another solvent is added to the resultant resin solution to precipitate resin particles, and then the solvent is removed to thereby produce resin particles; or a method in which a monomer mixture is allowed to be polymerized, the resultant resin is dissolved in a solvent with heating, the resultant resin solution is cooled to precipitate resin particles, and then the solvent is removed to thereby produce resin particles;

(e) a method in which a monomer mixture is allowed to be polymerized, the resultant resin is dissolved in a solvent, the resultant resin solution is dispersed in an aqueous medium in the presence of an appropriate dispersant, and then the dispersion liquid is subjected to heating or a reduced pressure to thereby remove the solvent; and (f) a method in which a monomer mixture is allowed to be polymerized, the resultant resin is dissolved in a solvent, and an appropriate emulsifying agent is dissolved in the resultant resin solution, followed by phase-transfer emulsification with the addition of water.

Of these, the method (a) is preferably employed, because the vinyl-based resin particles can be easily produced as a dispersion liquid, which is advantageous in easily being used at the next step.

In polymerization in the method (a), dispersion stability is preferably imparted to the resultant vinyl-based resin particles by adding a dispersion stabilizer to an aqueous medium, or adding a monomer capable of imparting dispersion stability to the resultant polymerized resin particles (i.e., a reactive emulsifier) to the monomer mixture to be polymerized. Alternatively, the above two means may be used in combination. When neither the dispersion stabilizer nor the reactive emulsifier is used, the particles cannot be maintained in a dispersion state whereby the vinyl-based resin cannot be obtained as particles; the resultant resin particles are poor in dispersion stability whereby they are poor in storage stability, resulting in aggregation during storage; or the particles are deteriorated in dispersion stability at the below-described resin particle-attaching step whereby core particles are easily aggregated or combined together, resulting in that the finally obtained toner is deteriorated in uniformity of particle diameter, shape, or surface, which is not preferred.

Examples of the dispersion stabilizer include surfactants and inorganic dispersants.

Examples of the surfactants include anionic surfactants such as alkylbenzenesulfonic acid salts, α-olefinsulfonic acid salts and phosphoric acid esters; cationic surfactants such as amine salt type cationic surfactants (e.g., alkylamine salts, aminoalcohol fatty acid derivatives, polyamine fatty acid derivatives and imidazoline) and quaternary ammonium salt type cationic surfactants (e.g., alkyltrimethyl ammonium salts, dialkyldimethyl ammonium salts, alkyldimethylbenzyl ammonium salts, pyridinium salts, alkylisoquinolinium salts and benzethonium chloride); nonionic surfactants such as fatty acid amide derivatives and polyalcohol derivatives; and amphoteric surfactants such as alanine, dodecyldi(aminoethyl)glycine, di(octylaminoethyl)glycine and N-alkyl-N,N-dimethylammonium betaine.

Examples of the inorganic dispersant include tricalcium phosphate, calcium carbonate, titanium oxide, colloidal silica and hydroxyapatite.

In the case of producing the resin particles, conventional chain transfer agents may be used for controlling the molecular weight of the resin particles.

The chain transfer agent is not particularly limited and may be appropriately selected depending on the intended purpose.

However, a C3 or higher hydrocarbon group-containing alkylmercaptan-based hydrophobic chain transfer agent is preferably used.

The C3 or higher hydrocarbon group-containing alkylmercaptan-based hydrophobic chain transfer agent is not particularly limited and may be appropriately selected depending on the intended purpose. Examples thereof include butanthiol, octanethiol, decanethiol, dodecanthiol, hexadecanthiol, octadecanthiol, cyclohexylmercaptan, thiophenol, octyl thioglycolate, octyl-2-mercaptopropionate, octyl-3-mercaptopropionate, 2-ethylhexyl mercaptopropionate, 2-mercaptoethyl octanoate, 1,8-dimercapto-3,6-dioxaoctane, decanetrithiol, and dodecylmercaptan. These may be used alone or in combination.

An amount of the chain transfer agent is not particularly limited, as long as the resultant copolymer can be controlled to have a desired molecular weight. It is preferably 0.01% by mole to 30% by mole, more preferably 0.1% by mole to 25% by mole, relative to the total moles of monomer components. When the amount of the chain transfer agent is less than 0.01% by mole, the resultant copolymer is increased in molecular weight, potentially leading to low fixability, or to gelation during polymerization. When the amount of the chain transfer agent is more than 30% by mole, unreacted chain transfer agent may remain, and the resultant copolymer is decreased in molecular weight, potentially leading to contamination of members.

The weight average molecular weight of the vinyl-based resin is not particularly limited and may be appropriately selected depending on the intended purpose. It is preferably 3,000 to 300,000, more preferably 4,000 to 100,000, further preferably 5,000 to 50,000. When the weight average molecular weight is lower than 3,000, the vinyl-based resin has low mechanical strength, i.e., the vinyl-based resin is brittle. Thus, surfaces of the finally obtained toner easily change depending on working environments in some applications. For example, problems are occurred such as a remarkable change in chargeability, contamination of surrounding members (e.g., adhesion of the toner), and degradation in image quality accompanying therewith, which are not preferred. When the weight average molecular weight is higher than 300,000, the number of molecular ends is decreased, so that molecular chains less interact with core particles to thereby deteriorate adhesion onto the core particles, which is not preferred.

The glass transition temperature (Tg) of the vinyl-based resin is preferably 40° C. or more, more preferably 50° C. or more, further preferably 60° C. or more. When the Tg is lower than 40° C., the finally obtained toner may be deteriorated in storage stability, for example, toner blocking may occur during storage at a high temperature, which is not preferred.

—Production Method of Toner—

A method for producing the toner is below-exemplified, but is not limited thereto.

The toner can be suitably obtained through a step of dissolving or dispersing at least a binder resin and a releasing agent into a solvent, and a step of dispersing the resultant solution or dispersion into an aqueous medium, followed by granulation. Moreover, the toner having a core-shell structure can be obtained through a step of adding at least a resin particle dispersion liquid, in which resin particles for a shell layer are dispersed, to a core particle dispersion liquid, in which the toner obtained through the aforementioned step is contained as core particles, to thereby form protrusions formed of the resin particles for a shell layer on surfaces of the core particles; and a step of removing an organic solvent from the core particle dispersion liquid dispersion liquid which has been used for forming the protrusions. The toner is preferably the toner having a core-shell structure. Notably, in the present invention, toner particles before the external additives are added may be referred to as toner base particles.

—Core Particle Granulating Step—

—Organic Solvent—

As for an organic solvent used for granulation, a volatile organic solvent having a boiling point lower than 100° C. is preferred because it can be easily removed at the subsequent step. Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination. Of these, preferred are esters such as methyl acetate and ethyl acetate; aromatic solvents such as toluene and xylene; and halogenated hydrocarbons such as methylene chloride, 1,2-dichloroethane, chloroform, and carbon tetrachloride. Polyester resin and the colorant may be dissolved or dispersed together, or may be separately dissolved or dispersed. In the latter case, an organic solvent used for dissolving or dispersing the polyester resin may be different from or the same as an organic solvent used for dissolving or dispersing the colorant. However, the same organic solvent is preferably used, taking into account the subsequent desolvation. When a solvent (alone or a mixture) into which the polyester resin is suitably dissolved is selected, a releasing agent suitably used in the present invention is hardly dissolved into the solvent due to a difference in solubility.

—Dissolving or Dispersing of Polyester Resin—

A solution or dispersion liquid of the polyester resin preferably contain the resin in a concentration of about 40% to about 80%. When the concentration is too high, the resin is difficult to be dissolved or dispersed, and the resultant solution or dispersion liquid is difficult to be handled because of its high viscosity. When the concentration is too low, an amount of the resultant particles is decreased, and an amount of the solvent to be removed is increased. In the case where the modified polyester resin containing a terminal isocyanate group is mixed with the polyester resin, the modified polyester resin may be mixed in the same solution or dispersion solution as the polyester resin, or a solution or dispersion liquid of the modified polyester resin may be separately produced. Taking into account the solubility and viscosity of the polyester resin and the modified polyester resin, it is preferred that solutions or dispersion liquids be separately produced.

—Aqueous Medium—

The aqueous medium may be water alone or a mixture of water and a water-miscible solvent. The water-miscible solvent is not particularly limited and may be appropriately selected depending on the intended purpose. Examples thereof include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone). An amount of the aqueous medium relative to 100 parts by mass of the resin particles is generally 50 parts by mass to 2,000 parts by mass, preferably 100 parts by mass to 1,000 parts by mass.

—Inorganic Dispersant and Organic Resin Particles—

When the solution or dispersion liquid of the polyester resin and the releasing agent is dispersed in the aqueous medium, an inorganic dispersant or organic resin particles are preferably dispersed in the aqueous medium in advance so as to stabilize a dispersion state thereof and give a sharp particle size distribution. Examples of the inorganic dispersant include tricalcium phosphate, calcium carbonate, titanium oxide, colloidal silica, and hydroxyapatite. A resin for forming the organic resin particles may be any resin as long as it is capable of forming an aqueous dispersion, and may be a thermoplastic resin or a thermosetting resin. Examples of the resin for forming the organic resin particles include a vinyl-based resin, a polyurethane resin, an epoxy resin, a polyester resin, a polyamide resin, a polyimide resin, a silicon-based resin, a phenolic resin, a melamine resin, a urea resin, an aniline resin, an ionomer resin, and a polycarbonate resin. These may be used in combination. Of these, the vinyl-based resin, the polyurethane resin, the epoxy resin, the polyester resin, and any combinations thereof are preferred from the viewpoint of easiness of obtaining an aqueous dispersion of fine spherical resin particles.

—Surfactant—

A surfactant may be used upon production of the resin particles, if necessary.

Examples of the surfactant include anionic surfactants such as alkylbenzenesulfonic acid salts, α-olefinsulfonic acid salts and phosphoric acid esters; cationic surfactants such as amine salt type cationic surfactants (e.g., alkylamine salts, aminoalcohol fatty acid derivatives, polyamine fatty acid derivatives and imidazoline) and quaternary ammonium salt type cationic surfactants (e g, alkyltrimethyl ammonium salts, dialkyldimethyl ammonium salts, alkyldimethylbenzyl ammonium salts, pyridinium salts, alkylisoquinolinium salts and benzethonium chloride); nonionic surfactants such as fatty acid amide derivatives and polyalcohol derivatives; and amphoteric surfactants such as alanine, dodecyldi(aminoethyl)glycine, di(octylaminoethyl)glycine and N-alkyl-N,N-dimethylammonium betaine.

Also, a fluoroalkyl group-containing surfactant can exhibit its effects even in a very small amount.

Examples the fluoroalkyl group-containing surfactant include a fluoroalkyl group-containing anionic surfactant and a fluoroalkyl group-containing cationic surfactant.

Examples the fluoroalkyl group-containing anionic surfactant include fluoroalkyl carboxylic acids having 2 to 10 carbon atoms and metal salts thereof, disodium perfluorooctanesulfonylglutamate, sodium 3-[ω-fluoroalkyl(C6 to C11)oxy)-1-alkyl(C3 or C4) sulfonates, sodium 3-[ω-fluoroalkanoyl (C6 to C8)-N-ethylamino]-1-propanesulfonates, fluoroalkyl (C11 to C20) carboxylic acids and metal salts thereof, perfluoroalkylcarboxylic acids(C7 to C13) and metal salts thereof, perfluoroalkyl(C4 to C12)sulfonates and metal salts thereof, perfluorooctanesulfonic acid diethanol amide, N-propyl-N-(2-hydroxyethyl)perfluorooctanesulfone amide, perfluoroalkyl(C6 to C10)sulfonamide propyltrimethylammonium salts, perfluoroalkyl(C6 to C10)-N-ethylsulfonylglycin salts and monoperfluoroalkyl(C6 to C16) ethylphosphate esters.

Examples the fluoroalkyl group-containing cationic surfactant include aliphatic primary, secondary or tertiary amine containing a fluoroalkyl group, aliphatic quaternary ammonium salts (e.g., perfluoroalkyl(C6 to C10)sulfonamide propyltrimethylammonium salts), benzalkonium salts, benzethonium chloride, pyridinium salts and imidazolinium salts.

—Protective Colloid—

A polymeric protective colloid may be used to stabilize dispersed liquid droplets.

Examples the protective colloid include acids (e.g., acrylic acid, methacrylic acid, α-cyanoacrylic acid, α-cyanomethacrylic acid, itaconic acid, crotonic acid, fumaric acid, maleic acid and maleic anhydride); hydroxyl group-containing (meth)acrylic monomers (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide); vinyl alcohol or ethers thereof (e.g., vinyl methyl ether, vinyl ethyl ether and vinyl propyl ether); esters formed between vinyl alcohol and a carboxyl group-containing compound (e.g., vinyl acetate, vinyl propionate and vinyl butyrate); acrylamide, methacrylamide, diacetone acrylamide or methylol compounds thereof; acid chlorides (e.g., chloride acrylate and chloride methacrylate); homopolymers or copolymers of nitrogen-containing compounds and nitrogen-containing heterocyclic compounds (e.g., vinyl pyridine, vinyl pyrrolidone, vinyl imidazole and ethyleneimine); polyoxyethylenes (e.g., polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearylphenyl ester and polyoxyethylene nonylphenyl ester); and celluloses (e.g., methyl cellulose, hydroxyethyl cellulose and hydroxypropyl cellulose).

When an acid- or alkali-soluble compound (e.g., calcium phosphate) is used as the dispersion stabilizer, the calcium phosphate may be dissolved with an acid (e.g., hydrochloric acid), followed by washing with water, to thereby remove it from the resultant particles. Alternatively, the calcium phosphate may be removed through enzymatic decomposition. When the dispersant is used, the dispersant may remain on surfaces of the toner particles. However, the dispersant is preferably removed through washing from the viewpoint of chargeability of the resultant toner.

—Dispersing Method—

A method for dispersing is not particularly limited, and any known dispersers such as a low-speed shearing disperser, a high-speed shearing disperser, a friction disperser, a high-pressure jet disperser or an ultrasonic disperser can be applied. The rotation speed of the high-speed shearing disperser is not particularly limited. It is generally 1,000 rpm to 30,000 rpm, preferably 5,000 rpm to 20,000 rpm. The temperature during dispersion is generally 0° C. to 150° C. (under pressure), preferably 20° C. to 80° C.

—Preparation Step of Oil Phase—

An oil phase in which a resin, a colorant, and a releasing agent, etc. are dissolved or dispersed in an organic solvent may be prepared by gradually adding the resin, the colorant, etc. to the organic solvent under stirring to thereby dissolve or disperse them. Notably, when a pigment is used as the colorant and/or when the releasing agent, the charge controlling agent, etc. used are poorly dissolvable to the organic solvent, these materials are preferably micronized prior to addition to the organic solvent.

As described above, the colorant may be formed into a masterbatch. Similarly, the releasing agent, the charge controlling agent, etc. may be formed into a masterbatch.

In another means, the colorant, the releasing agent and the charge controlling agent may be dispersed through a wet process into the organic solvent, if necessary, in the presence of a dispersion aid, to thereby obtain a wet master.

In still another means, when dispersing a material of which melting point is lower than the boiling point of the organic solvent, microcrystals of a dispersoid may be produced as follows. Firstly, the material is heated while stirring together with the dispersoid in the organic solvent, if necessary, in the presence of a dispersion aid, and then the resultant solution is cooled with stirring or shearing to thereby crystallize the dispersoid.

The colorant, the releasing agent and the charge controlling agent which have been dissolved or dispersed into the organic solvent together with the resin using any of the above means may be further dispersed. The dispersion may be performed using a known disperser such as a bead mill or a disc mill.

—Preparation Step of Core Particles—

A method for preparing a dispersion liquid in which oil phases serving as core particles are dispersed in the aqueous medium by dispersing the oil phase from the aforementioned step into the aqueous medium is not particularly limited. Any known dispersers such as a low-speed shearing disperser, a high-speed shearing disperser, a friction disperser, a high-pressure jet disperser or an ultrasonic disperser can be applied. Of these, the high-speed shearing disperser is preferably used to form dispersoids having a particle diameter of 2 μm to 20 μm. The rotation speed of the high-speed shearing disperser is not particularly limited, but is generally 1,000 rpm to 30,000 rpm, preferably 5,000 rpm to 20,000 rpm. The dispersion time is not particularly limited, but is generally 0.1 min to 5 min in a batch manner. When the dispersion time exceeds 5 min, unfavorable small particles may remain and excessive dispersion is performed to make the dispersion system unstable, potentially leading to formation of aggregates and coarse particles, which is not preferred. The temperature during dispersion is generally 0° C. to 40° C., preferably 10° C. to 30° C. When the dispersion temperature exceeds 40° C., molecular movements are excited to deteriorate dispersion stability, leading to formation of aggregates and coarse particles, which is not preferred. When the dispersion temperature is lower than 0° C., the dispersion is increased in viscosity, so that more shearing energy is required for dispersion, leading to a drop in production efficiency.

The surfactant may be used which is the same as those mentioned in the above-described production method of the resin particles. In order to efficiently disperse oil droplets containing the solvent, the surfactant used is preferably a disulfonic acid salt having a relatively high HLB. An amount of the surfactant contained in the aqueous medium is 1% by mass to 10% by mass, preferably 2% by mass to 8% by mass, more preferably 3% by mass to 7% by mass. When the amount exceeds 10% by mass, oil droplets become too small. Additionally, a reverse micellar structure is formed to thereby deteriorate dispersion stability, leading to formation of coarse oil droplets. When the amount is lower than 1% by mass, oil droplets cannot be stably dispersed, leading to formation of coarse oil droplets. Needless to say, both cases are not preferred.

—Adhesion Step of Resin Particle for Shell Layer—

The resultant core particle dispersion liquid may contain stable liquid droplets of the core particles, so long as the dispersion liquid is being stirred. To the core particle dispersion liquid in this state, is added the vinyl-based resin particle dispersion liquid to thereby attach the vinyl-based resin particles to the core particles. The vinyl-based resin particle dispersion liquid is preferably added thereto for 30 sec or longer. When it is added for 30 sec or shorter, the dispersion system drastically changes to form aggregated particles. In addition, the vinyl-based resin particles are ununiformly attached onto the core particles. Needless to say, both cases are not preferred. Meanwhile, adding the vinyl-based resin particle dispersion liquid over an unnecessarily long period of time (e.g., 60 min or longer) is not preferred from the viewpoint of lowering production efficiency.

The vinyl-based resin particle dispersion liquid may be appropriately diluted or concentrated for adjusting its concentration before it is added to the core particle dispersion liquid. The concentration of the vinyl-based resin particle dispersion liquid is preferably 5% by mass to 30% by mass, more preferably 8% by mass to 20% by mass. When the concentration is less than 5% by mass, the organic solvent is greatly changed in concentration upon addition of the dispersion liquid, leading to insufficient adhesion of the resin particles. When the concentration exceeds 30% by mass, the resin particles tend to be unevenly distributed in the core particle dispersion liquid, leading to ununiformly adhesion of the resin particles. Needless to say, both cases are not preferred.

The following may describe the reason why the resin particles are sufficiently firmly attached onto the core particles by the method of the present invention. Specifically, when the resin particles are attached onto the liquid droplets of the core particles, the core particles can freely deform to sufficiently form contact surfaces with the resin particles. Additionally, the resin particles are swelled with or dissolved in the organic solvent to make it easier for the resin particles to attach to the resin in the core particles. Therefore, in this state, the organic solvent must exist in the system in a sufficiently large amount. Specifically, in the core particle dispersion liquid, the amount of the organic solvent is 10% by mass to 70% by mass, preferably 30% by mass to 60% by mass, further preferably 40% by mass to 55% by mass, relative to that of a solid matter (e.g., the resin, the colorant, and if necessary, the releasing agent and the charge controlling agent). When the amount of the organic solvent exceeds 70% by mass, the amount of the colored resin particles obtained through one production process is decreased, resulting in low production efficiency. Also, a large amount of the organic solvent impairs dispersion stability, leading to re-aggregation and making it difficult to attain stable production. Needless to say, both cases are not preferred. When the amount is smaller than 10%, the resin particles cannot be attached to the core particles with the sufficient strength as described above, which is not preferred. In the case where the preferred organic solvent concentration at the time when the resin particles are attached is lower than the preferred organic solvent concentration during the production of the core particles, the core particles are prepared, and then the organic solvent concentration may be adjusted by partially removing the organic solvent to thereby attach the resin particles to the core particles, followed by removing the organic solvent completely. Notably, the "removing the organic solvent completely" means removing the organic solvent to the extent of what can be removed by a conventional known method in the below-described desolvation step.

The temperature at which the vinyl-based resin particles are allowed to attach onto the core particles is preferably 10° C. to 60° C., more preferably 20° C. to 45° C. When the temperature exceeds 60° C., more energy is required for production to increase environmental loading, and the presence of vinyl-based resin particles having a low acid value on surfaces of liquid droplets makes the dispersion system to be unstable to thereby potentially form coarse particles. When the temperature is less than 10° C., the dispersion liquid is increased in viscosity, leading to an insufficiently attachment of the resin particles. Needless to say, both cases are not preferred.

—Desolvation—

A known method can be used for removing the organic solvent from the resultant colored resin dispersion. For example, the following method can be employed. Specifically, the entire system is gradually increased in temperature under a normal pressure or a reduced pressure, to thereby completely evaporate off the organic solvent contained in the liquid droplets.

—Elongation and/or Cross-Linking Reaction—

In the case where the modified polyester resin containing a terminal isocyanate group and amines reactive therewith are added for the purpose of introducing the modified polyester resin containing an urethane and/or urea group, the amines may be mixed in the oil phase before a toner composition is dispersed into the aqueous medium, or the amines may be added to the aqueous medium. The duration for the reaction is selected depending on the reactivity between the isocyanate group contained in the polyester prepolymer and the amines to be added. It is generally 1 min to 40 hours, preferably 1 hour to 24 hours. The reaction temperature is generally 0° C. to 150° C., preferably 20° C. to 98° C.

—Washing and Drying Step—

A known technique is used for a step of washing and drying the toner particles dispersed in the aqueous medium.

Specifically, after performing solid-liquid separation by means of a centrifugal separator or filter press, the resultant toner cake is again dispersed in an ion-exchanged water having the temperature in the range of normal temperature to about 40° C., optionally followed by adjusting the pH with acid or alkali, and then solid-liquid separation is again performed. This series of operations are repeated a few times to thereby remove impurities and the surfactant. Thereafter, the resultant is dried by a flash dryer, a circulating dryer, a vacuum dryer, or a vibration flow dryer to thereby obtain toner powder. During this operation, fine particles in the toner may be removed by centrifugal separation. Alternatively, classification may be performed by means of a known classification device after the drying to obtain a desired particle size distribution of the toner.

—External Addition Treatment—

Specific examples of a means of external adding the inorganic particles surface-treated with the silicone oil serving as the external additive or other external additive to the resultant dried toner powder include a method in which impact is applied to a mixture using a high-speed rotating blade; and a method in which a mixture is caused to pass through a high-speed airflow for acceleration to thereby allow particles or aggregates contained in the mixture to collide with each other or with an appropriate collision plate. Examples of a device used for external adding include ONGMILL (product of Hosokawa Micron Corp.), a modified I-type mill (product of Nippon Neumatic Co., Ltd.) so as to reduce the pulverizing air pressure, HYBRIDIZATION SYSTEM (product of Nara Machinery Co., Ltd.), CRYPTRON SYSTEM (production of Kawasaki Heavy Industries, Ltd.) and an automatic mortar.

The volume average particle diameter of the toner is not particularly limited and may be appropriately selected depending on the intended purpose. It is preferably 3 μm to 9 μm, more preferably 4 μm to 8 μm, further preferably 4 μm to 7 μm. When the volume average particle diameter is less than 3 μm, the toner is relatively increased in adhesion force and deteriorated in operability under an electrical field, which makes it difficult to employ an inexpensive blade cleaning. When the volume average particle diameter exceeds 9 μm, image quality (e.g., reproducibility of thin lines) is deteriorated. When the volume average particle diameter falls within 3 μm to 9 μm, an inexpensive electrophotographic system which results in good image quality can be provided.

The ratio of the volume average particle diameter to the number average particle diameter of the toner (volume average particle diameter/number average particle diameter) is not particularly limited and may be appropriately selected depending on the intended purpose. It is preferably 1.25 or less, more preferably 1.20 or less, further preferably 1.17 or less. When the ratio exceeds 1.25, during repetitive use, toner particles having a large particle diameter or, in some cases, toner particles having a small particle diameter are preferentially consumed, so that the average particle diameter of the toner particles remaining in a developing apparatus is different from that of the toner particles at an initial state. Thus, an initial developing condition is not optimal for development of the remaining toner particles. As a result, various unfavorable phenomena tend to occur including charging failure, considerable increase or decrease of the conveyed amount of toner particles, toner clogging and toner leakage.

—Method for Measuring Volume Average Particle Diameter and Number Average Particle Diameter—

Next, a method for measuring particle size distribution of the toner particles will be described.

Examples of a measurement device used in a coulter counter method include a COULTER COUNTER TA-II and COULTER MULTISIZER II (these products are of Coulter, Inc.). The measurement method is as follows.

First, 0.1 mL to 5 mL of a surfactant (preferably an alkylbenzene sulfonic acid salt) serving as a dispersant is added to 100 mL to 150 mL of an electrolyte solution. Here, the electrolyte solution is an about 1% aqueous NaCl solution prepared using 1st grade sodium chloride, and, for example, ISOTON-II (product of Coulter, Inc.) can be used. Subsequently, a measurement sample (solid content: 2 mg to 20 mg) is suspended in the resultant solution. The resultant electrolyte solution, in which the sample is dispersed, is dispersed with an ultrasonic wave disperser for about 1 min to about 3 min. The thus-obtained dispersion liquid is analyzed with the above-listed measurement device using an aperture of 100 μM to measure the number and volume of the toner particles or the toner. Based on the number and the volume, the volume distribution and the number distribution are calculated. From thus-obtained distributions, the volume average particle diameter (Dv) and number average particle diameter (Dn) of the toner can be determined.

Notably, in this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) are subjected to the measurement.

An average circularity of the toner is preferably 0.96 to 1.00.

The image forming apparatus of the present invention can prevent contamination of an electrostatic latent image bearing member even when the spherical toner is used by setting a developing pressure and the extracted amount of the releasing agent from the toner so as to fall within a proper range; and can also provide high quality image due to the use of the spherical toner.

—Measurement Method of Average Circularity—

An optical detection method can be suitably used for measuring the shape of the toner in which particle images are optically detected and analyzed by a CCD camera while a suspension liquid containing particles passes through an imaging detective portion in the form of a plate. The "average circularity" of the particles is obtained by dividing the circumferential length of a circle having the area equal to thus obtained projected toner area by the circumferential length of actual particles.

The "average circularity" in the present invention refers to a value measured using a flow-type particle image analyzer FPIA-3000. Specifically, 0.1 mL to 0.5 mL of a surfactant (preferably an alkylbenzene sulfonic acid salt) serving as a dispersant is added into 100 mL to 150 mL of water in a container, from which solid impurities have previously been removed. Then, about 0.1 g to about 0.5 g of a measurement sample is added to the container. The resultant is dispersed with an ultrasonic wave disperser for about 1 min to about 3 min. The concentration of the resultant dispersion liquid is adjusted such that the number of particles of the sample is 3,000 per microliter to 10,000 per microliter. In this state, the shape and distribution of the toner are measured using the analyzer.

<Electrostatic Latent Image Bearing Member>

The material, structure, and size of the electrostatic latent image bearing member are not particularly limited and may be appropriately selected from those know in the art. The electrostatic latent image bearing member may be an inorganic photoconductor made of, for example, amorphous silicon or selenium, or an organic photoconductor made of, for example, polysilane or phthalopolymethine. Of these, an amorphous silicon photoconductor is preferred from the viewpoint of a long service life.

The amorphous silicon photoconductor may be a photoconductor having a support and a photoconductive layer of a-Si, which is formed on the heated support of 50° C. to 400° C. using a film forming method such as a vacuum vapor deposition method, a sputtering method, an ion plating method, a thermal CVD (Chemical Vapor Deposition) method, a photo-CVD method or a plasma CVD method. Of these, a plasma CVD method is suitably employed, in which gaseous raw materials are decomposed through application of direct current or high-frequency or microwave glow discharge to thereby form an a-Si deposition film on the support.

The shape of the electrostatic latent image bearing member is not particularly limited and may be appropriately selected depending on the intended purpose, but is preferably cylindrical. The outer diameter of the cylindrical electrostatic latent image bearing member is not particularly limited and may be appropriately selected depending on the intended purpose. It is preferably 3 mm to 100 mm, more preferably 5 mm to 50 mm, particularly preferably 10 mm to 30 mm.

<Electrostatic Latent Image Forming Unit and Electrostatic Latent Image Forming Step>

The electrostatic latent image forming unit is not particularly limited and may be appropriately selected depending on the intended purpose, as long as it is a unit configured to form an electrostatic latent image on the electrostatic latent image bearing member. Example thereof includes a unit including at least a charging member configured to charge a surface of the electrostatic latent image bearing member and an exposing member configured to imagewise-expose the surface of the electrostatic latent image bearing member.

The electrostatic latent image forming step is not particularly limited and may be appropriately selected depending on the intended purpose, as long as it is a step of forming an electrostatic latent image on the electrostatic latent image bearing member. For example, the electrostatic latent image forming step is performed with the electrostatic latent image forming unit by charging a surface of the electrostatic latent image bearing member, followed by imagewise-exposing.

—Charging Member and Charging—

The charging member is not particularly limited and may be appropriately selected depending on the intended purpose. Examples thereof include contact type chargers known per se having, for example, an electroconductive or semielectroconductive roller, brush, film and rubber blade; and non-contact type chargers utilizing corona discharge such as corotron and scorotron.

The charging can be performed by, for example, applying a voltage to a surface of the electrostatic latent image bearing member using the charging member.

The charging member may be in any shape such as a roller as well as a magnetic brush and a fur brush. The shape may be suitably selected according to specification or configuration of the image forming apparatus.

When the magnetic brush is used as the charging member, the magnetic brush includes various ferrite particles (e.g., Zn—Cu ferrite) serving as a charging member, a non-magnetic electroconductive sleeve for supporting the ferrite particles, and a magnetic roller included in the non-magnetic electroconductive sleeve.

When the fur brush is used as the charging member, the fur brush may be made of a fur electroconductive-treated with, for example, carbon, copper sulfide, a metal or a metal oxide, and the fur may be coiled or mounted to a metal or other electroconductive-treated core to thereby obtain the charging member.

The charging member is not limited to the aforementioned contact type chargers. However, the contact type chargers are preferably used from the viewpoint of reducing the amount of ozone generated from the charger member in the image forming apparatus.

—Exposing Member and Exposing—

The exposing member is not particularly limited and may be appropriately selected depending on the intended purpose, so long as it can imagewise-expose a surface of the electrostatic latent image bearing member which has been charged by the charging member. Examples thereof include various exposing members such as a copy optical exposing member, a rod lens array exposing member, a laser optical exposing member, and a liquid crystal shutter exposing member.

A light source used for the exposing member is not particularly limited and may be appropriately selected depending on the intended purpose. Examples thereof include conventional light-emitting devices such as a fluorescent lamp, a tungsten lamp, a halogen lamp, a mercury lamp, a sodium lamp, a light-emitting diode (LED), a laser diode (LD) and an electroluminescence (EL) device.

Also, various filters may be used for emitting only light having a desired wavelength range. Examples of the filters include a sharp-cut filter, a band-pass filter, an infrared cut filter, a dichroic filter, an interference filter and a color temperature conversion filter.

The exposing can be performing by, for example, imagewise-exposing a surface of the electrostatic latent image bearing member using the exposing member.

Notably, in the present invention, a back-exposure method can be employed in which the back side of the electrostatic latent image bearing member is imagewise exposed.

<Developing Unit and Developing Step>

The developing unit is not particularly limited and may be appropriately selected from, for example, known contact type one-component developing units depending on the intended purpose, as long as it is a contact type one-component developing unit which contains the toner, which is configured to developing with the toner the electrostatic latent image formed on the electrostatic latent image bearing member to thereby form a visible image, and which includes a toner bearing member in contact with the electrostatic latent image bearing member.

The developing step is not particularly limited and may be appropriately selected depending on the intended purpose, as long as it is a contact type one-component developing step which is a step of developing with the toner the electrostatic latent image formed on the electrostatic latent image bearing member to thereby form a visible image, and which uses a toner bearing member in contact with the electrostatic latent image bearing member. For example, the developing step can be suitably performed by the developing unit.

The developing unit may employ a dry developing system, or a wet developing system. The developing unit may be a developing unit for a single color, or a developing unit for multicolor.

The developing unit preferably includes a toner bearing member and a thin layer-forming member. Here, the toner bearing member is configured to bear a toner on a circumferential surface thereof, rotate with being in contact with the electrostatic latent image bearing member, and develop the electrostatic latent image which has been formed on the electrostatic latent image bearing member by supplying the toner thereto. The thin layer-forming member is configured to come into contact with the circumferential surface of the toner bearing member to form a thin layer of the toner on the toner bearing member.

—Contact Pressure Between Electrostatic Latent Image Bearing Member and Toner Bearing Member—

A contact pressure (developing pressure) between the electrostatic latent image bearing member and the toner bearing member is not particularly limited and may be appropriately selected depending on the intended purpose, as long as it is $2.0\times10^4$ N/m$^2$ to $7.5\times10^4$N/m$^2$. It is preferably $3.0\times10^4$N/m$^2$ to $7.2\times10^4$N/m$^2$.

When the contact pressure is less than $2.0\times10^4$N/m$^2$, a white void may be occurred at an image end portion due to instable contact of an end portion of the toner bearing member against the electrostatic latent image bearing member. When the contact pressure is more than $7.5\times10^4$N/m$^2$, the rubbing force of the electrostatic latent image bearing member becomes large, leading to contamination of the electrostatic latent image bearing member.

When a toner containing the releasing agent (e.g., wax) in a large amount is used, a toner component such as an exfoliated external additive forms aggregates with the releasing agent due to deterioration of a residual toner remaining on the electrostatic latent image bearing member and the toner bearing member, so that the aggregates tend to be an initiation point of toner adhesion. Thus, a member such as the electrostatic latent image bearing member is contaminated. When the contact pressure between the electrostatic latent image bearing member and the toner bearing member falls within the above-described range, a reduced stress is applied to the toner at a developing nip, so that toner deterioration and contamination of a member accompanying therewith (e.g., adhesion of the toner component to the electrostatic latent image bearing member) can be prevented.

—Circumferential Speed Ratio Cd/Cp of Circumferential Speed of Toner Bearing Member Cd to Circumferential Speed of Electrostatic Latent Image Bearing Member Cp—

A circumferential speed ratio Cd/Cp of a circumferential speed of the toner bearing member Cd (m/sec) to a circumferential speed of the electrostatic latent image bearing member Cp (m/sec) is not particularly limited and may be appropriately selected depending on the intended purpose. It is preferably 1.2 to 1.6.

When the circumferential speed ratio Cd/Cp is less than 1.2, a toner may not be supplied in an amount required for developing. When the circumferential speed ratio Cd/Cp is more than 1.6, abrasion of the electrostatic latent image bearing member may be unnecessarily promoted.

The toner bearing member is not particularly limited and may be appropriately selected depending on the intended purpose. A metal roller or elastic roller can be suitably used.

The metal roller is not particularly limited and may be appropriately selected depending on the intended purpose. Examples thereof include an aluminum roller. By treating the metal roller through blast treatment, the toner bearing member having a desired surface friction coefficient can be formed relatively easily. Specifically, an aluminum roller can be treated through glass bead blasting to thereby roughen a surface thereof. Onto the thus-obtained roller, an appropriate amount of toner can be attached.

A roller coated with an elastic rubber layer may be used as the elastic roller. The roller further includes thereon a surface coat layer made of a material that is easily chargeable to the opposite polarity to that of the toner. The hardness of the elastic rubber layer is preferably set to be equal to or lower than 60° according to JIS-A, in order to prevent the toner from being deteriorated due to pressure concentration at a contact portion with the thin layer-forming member. The surface roughness (Ra) of the elastic rubber layer is preferably set to be 0.3 μm to 2.0 μm so as to retain a necessary amount of the toner thereon. Also, because a developing bias is applied to the toner bearing member for forming an electrical field between the toner bearing member and the electrostatic latent image bearing member, the resistance of the elastic rubber layer is preferably set to be $10^3\Omega$ to $10^{10}\Omega$.

The thin layer-forming member is made of a metal plate spring of, for example, stainless steel (SUS) or phosphor bronze, and its free end is brought into contact with the surface of the toner bearing member at a pressure of 10 N/m$^2$ to 40 N/m$^2$. The thin layer-forming member is configured to form the toner which has applied the pressure into a thin layer and frictionally charge the toner. In addition, for aiding frictional charging, the thin layer forming member receives a regulation bias having a value offset in the same direction as the polarity of the toner against the developing bias.

The rubber elastic material forming the surface of the toner bearing member is not particularly limited and may be appropriately selected depending on the intended purpose. Examples thereof include a styrene-butadiene copolymer rubber, an acrylonitrile-butadiene copolymer rubber, an acrylic rubber, an epichlorohydrin rubber, a urethane rubber, a silicone rubber or blends thereof. Of these, particularly preferred is a blend of an epichlorohydrin rubber and an acrylonitrile-butadiene copolymer rubber.

For example, a circumference of an electroconductive shaft is coated with the rubber elastic material to thereby obtain the toner bearing member. The electroconductive shaft is made, for example, of a metal such as stainless steel (SUS).

<Deteriorated Toner Removing Unit and Deteriorated Toner Removing Step>

The deteriorated toner removing unit is not particularly limited and may be appropriately selected depending on the intended purpose, as long as it is a unit configured to supply the toner to the electrostatic latent image bearing member in an amount to allow the toner to be borne on at least an entire circumferential surface of the toner bearing member to thereby remove a deteriorated toner remaining on the electrostatic latent image bearing member and the toner bearing member. Example thereof include a unit capable of controlling the operation of each of, for example, the electrostatic latent image bearing member, the toner bearing member, and a supplying roller configured to supply the toner to the toner bearing member (e.g., a device such as a sequencer and a computer). Hereinafter, the deteriorated toner removing unit may be referred as a "toner refresh controlling unit".

The deteriorated toner removing step is not particularly limited and may be appropriately selected depending on the intended purpose, as long as it is a step of supplying the toner to the electrostatic latent image bearing member in an amount to allow the toner to be borne on at least an entire circumferential surface of the toner bearing member to thereby remove a deteriorated toner remaining on the electrostatic latent image bearing member and the toner bearing member. Hereinafter, the deteriorated toner removing step may be referred as a "toner refresh controlling step".

The deteriorated toner removing step can be suitably performed by the deteriorated toner removing unit.

The residual toner (deteriorated toner) remaining on the electrostatic latent image bearing member and the toner bearing member can be removed, so that toner deterioration and contamination of a member accompanying therewith (e.g., adhesion of the toner component to the electrostatic latent image bearing member) can be prevented by supplying the toner to the electrostatic latent image bearing member (in a circumferential direction) so as to form an entirely solid image at a certain density in an amount to allow the toner to be borne on at least an entire circumferential surface of the toner bearing member.

<Other Units and Other Steps>

Examples of the other units include a transfer unit, a fixing unit, a cleaning unit, a charge-eliminating unit, a recycling unit, and a control unit.

Examples of the other steps include a transfer step, a fixing step, a cleaning step, a charge-eliminating step, a recycling step, and a control step.

—Transfer Step and Transfer Unit—

The transfer unit is not particularly limited and may be appropriately selected depending on the intended purpose, as long as it is a unit configured to transfer a visible image onto a recording medium. The transfer unit preferably has a primary transfer unit configured to transfer a visible image onto an intermediate transfer medium to form a composite transfer image, and a secondary transfer unit configured to transfer the composite transfer image onto a recording medium.

The transfer step is not particularly limited and may be appropriately selected depending on the intended purpose, as long as it is a step of transferring a visible image onto a recording medium. The transfer step preferably includes primarily transferring a visible image onto an intermediate transfer medium, and then secondarily transferring the visible image onto the recording medium.

The transfer step can be performed by, for example, charging the photoconductor using a transfer charger, and can be suitably performed by the transfer unit.

Here, when an image to be secondarily transferred onto the recording medium is a color image of several color toners, a configuration can be employed in which the transfer unit sequentially superposes the color toners on top of another on the intermediate transfer medium to form an image on the intermediate transfer medium, and the image on the intermediate transfer medium is secondarily transferred at one time onto the recording medium by the intermediate transfer unit.

Notably, the intermediate transfer medium is not particularly limited and may be appropriately selected from known transfer media depending on the intended purpose. Preferred examples thereof include a transfer belt.

The transfer unit (the primary transfer unit or the secondary transfer unit) preferably includes at least a transfer device configured to transfer the visible image which has been formed on the photoconductor toward the recording medium through charging. The number of the transfer unit may be one, or two or more. Examples of the transfer device include a corona transfer device using corona discharge, a transfer belt, a transfer roller, a pressure transfer roller and an adhesive transfer device.

Notably, typical examples of the recording medium include plain paper. The recording medium, however, is not particularly limited and may be appropriately selected depending on the intended purpose, so long as it can receive an unfixed image formed after development. Further examples of the recording medium include PET bases for use in OHP.

—Fixing Unit and Fixing Step—

The fixing unit is not particularly limited and may be appropriately selected depending on the intended purpose, as long as it is a unit configured to fix a transferred image which has been transferred on the recording medium. The fixing unit is preferably a known heat-press member. Examples of the heat-press member include a combination of a heating roller and a pressing roller, and a combination of a heating roller, a pressing roller and an endless belt.

The fixing step is not particularly limited and may be appropriately selected depending on the intended purpose, as long as it is a step of fixing a visible image which has been transferred onto the recording medium. The fixing step may be performed every time when each toner image is transferred onto the recording medium or at one time after the toner images of colors are superposed.

The fixing step can be suitably performed by the fixing unit.

The heating temperature of the heat-press member is preferably 80° C. to 200° C.

Notably, in the present invention, a known optical fixing device may be used in addition to or instead of the fixing unit depending on the intended purpose.

A surface pressure at the fixing step is not particularly limited and may be appropriately selected depending on the intended purpose, but is preferably 10 $N/cm^2$ to 80 $N/cm^2$.

—Cleaning Unit and Cleaning Step—

The cleaning unit is not particularly limited and may be appropriately selected depending on the intended purpose, as long as it is a unit capable of removing the toner remaining on the electrostatic latent image bearing member (photoconductor). Examples thereof include a magnetic blush cleaner, an electrostatic brush cleaner, a magnetic roller cleaner, a blade cleaner, a brush cleaner and a web cleaner. Of these, a blade cleaner is preferred from the viewpoint of low-price.

The cleaning step is not particularly limited and may be appropriately selected depending on the intended purpose, as long as it is a step of removing the toner remaining on the electrostatic latent image bearing member. The cleaning step can be suitably performed by the cleaning unit.

—Charge-Eliminating Unit and Charge-Eliminating Step—

The charge-eliminating unit is not particularly limited and may be appropriately selected depending on the intended purpose, as long as it is a unit configured to apply a charge-eliminating bias to the electrostatic latent image bearing member (photoconductor) to thereby charge-eliminate. Example thereof includes a charge-eliminating lamp.

The charge-eliminating step is not particularly limited and may be appropriately selected depending on the intended purpose, as long as it is a step of applying a charge-eliminating bias to the electrostatic latent image bearing member to thereby charge-eliminate. The charge-eliminating step can be suitably performed by the charge-eliminating unit.

—Recycling Unit and Recycling Step—

The recycling unit is not particularly limited and may be appropriately selected depending on the intended purpose, as long as it is a unit configured to recycle the toner which has been removed at the cleaning step to the developing apparatus. Example thereof includes a known conveying unit.

The recycling step is not particularly limited and may be appropriately selected depending on the intended purpose, as long as it is a step of recycling the toner which has been removed at the cleaning step to the developing apparatus. The recycling step can be suitably performed by the recycling unit.

—Control Unit and Control Step—

The control unit is not particularly limited and may be appropriately selected depending on the intended purpose, as long as it can control the operation of each of the above units. Examples thereof include a device such as a sequencer and a computer.

The control step is not particularly limited and may be appropriately selected depending on the intended purpose, as long as it is a step of controlling the operation of each of the above steps. The control step can be suitably performed by the control unit.

The image forming apparatus of the present invention may include a process cartridge including an electrostatic latent image bearing member, an electrostatic latent image forming unit, a developing unit, and, if necessary, other units (e.g., a cleaning unit). The process cartridge may be detachably mounted in a main body of the image forming apparatus. Alternatively, at least one selected from a charging unit, an exposing unit, a developing unit, a transfer unit, a separating unit, and a cleaning unit may be supported together with the electrostatic latent image bearing member to form a process cartridge. The image forming apparatus may have a configuration in which the process cartridge is a single unit detachably mounted in the main body of the image forming apparatus using a guiding unit such as a rail provided in the main body of the image forming apparatus.

Figure 2:
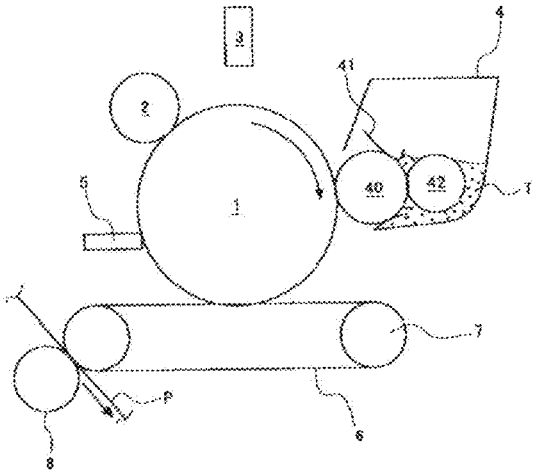
FIG. 2 is a view of one exemplary image forming apparatus of the present invention.

FIG. 2 is a view of one exemplary image forming apparatus of the present invention. The image forming apparatus contains, in a main body casing (not illustrated), an electrostatic latent image bearing members (1) configured to rotate clockwise in FIG. 2. For example, a charging device (2), an exposing device (3), a developing apparatus (4) serving as a developing unit configured to contain the toner (T), a cleaning portion (5), an intermediate transfer medium (6), a supporting roller (7), a transfer roller (8) and a charge-eliminating unit (not illustrated) are provided around the electrostatic latent image bearing members (1).

This image forming apparatus includes a paper-feeding cassette (not illustrated) containing a plurality of recording paper sheets serving as a recording medium. The recording paper sheets (P) contained in the paper-feeding cassette are fed one by one to between the intermediate transfer medium (6) and the transfer roller (8). Until fed to therebetween, the recording paper sheets are retained with a pair of registration rollers (not illustrated) so that it can be fed at a desired timing.

In this image forming apparatus, the electrostatic latent image bearing members (1) is uniformly charged with the charging device (2) while being rotated clockwise in FIG. 2. Then, the electrostatic latent image bearing member (1) is irradiated with laser beams modulated by image date from the exposing device (3), to thereby form an electrostatic latent image on the electrostatic latent image bearing member (1). The electrostatic latent image formed on the electrostatic latent image bearing member (1) is developed with the toner using the developing apparatus (4). Next, a toner image which has been formed by the developing apparatus (4) is transferred from the electrostatic latent image bearing member (1) to the intermediate transfer member (6) by applying the transfer bias to the intermediate transfer member (6), and the toner image is then transferred onto the recording paper sheet (P) by transporting the recording paper sheet (P) to between the intermediate transfer member (6) and the transfer roller (8). The recording paper sheet (P) on which the toner image has been transferred is then transported to a fixing unit (not illustrated).

The fixing unit is equipped with a fixing roller configured to be heated to the predetermined fixing temperature by a built-in heater, and a pressing roller configured to be pressed against the fixing roller with the predetermined pressure. The fixing unit heats and presses the recording paper sheet transported by the transfer roller (8) to thereby fix the toner image on the recording paper sheet, followed by output the recording paper sheet onto a paper discharging tray (not illustrated).

Meanwhile, in the image forming apparatus, the electrostatic latent image bearing member (1), from which the toner image has been transferred to the recording paper sheet by the transfer roller (8), is further rotated, and the residual toner remaining on the surface of the electrostatic latent image bearing member (1) is removed by scraping at the cleaning portion (5), followed by charge-eliminating by a charge-eliminating device (not illustrated). The image forming apparatus enters into the next image formation operation after uniformly charging the electrostatic latent image bearing member (1), which has been charge-eliminated by the charge-eliminating device, by the charging device (2).

A toner bearing member (40) rotates clockwise to thereby transport the toner carried on the surface thereof to a position facing a thin-layer forming member (41) and the electrostatic latent image bearing member (1). The thin-layer forming member (41) is provided in a position that is lower than a contact position of a supplying roller (42) with the toner bearing member (40).

Figure 3:
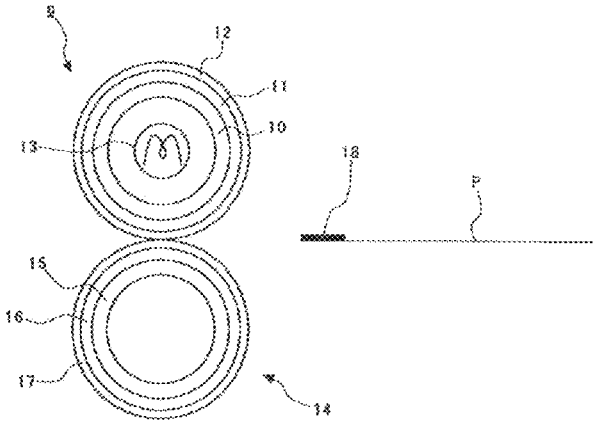
FIG. 3 is a view of one exemplary fixing unit in an image forming apparatus of the present invention.

The fixing unit may be a soft roller-type fixing device having fluorine-containing surface layers as illustrated in FIG. 3.

A heating roller (9) includes an aluminum core (10); an elastic material layer (11) of silicone rubber and PFA (tetrafluoroethylene-perfluoroalkyl vinyl ether copolymer) surface layer (12) both of which are provided on the aluminum core; and a heater (13) which is provided inside the aluminum core. The pressing roller (14) includes an aluminum core (15); and an elastic material layer (16) of silicone rubber and a PFA surface layer (17) both of which are provided on the aluminum core. Notably, the recording paper sheet (P) on which an unfixed image (18) has been printed is fed as illustrated.

<Multi-Color Image Forming Apparatus>

Figure 4:
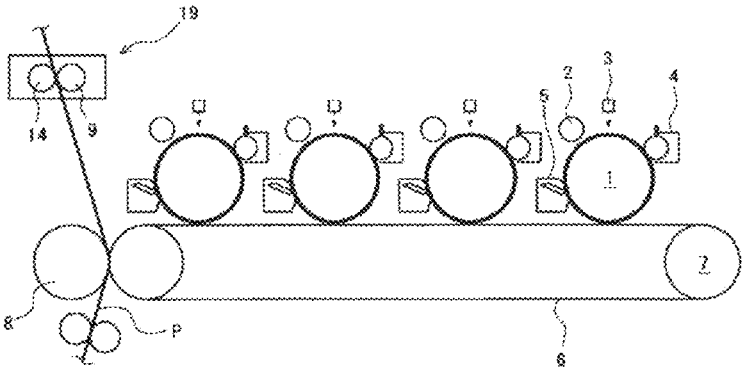
FIG. 4 is a schematic view of one exemplary full-color image forming apparatus of the present invention.

FIG. 4 is a schematic view of one exemplary multi-color image forming apparatus of the present invention. The multi-color image forming apparatus illustrated in FIG. 4 is a tandem-type full color image forming apparatus.

In FIG. 4, the image forming apparatus contains, in a main body casing (not illustrated), an electrostatic latent image bearing members (1) configured to rotate clockwise in this figure. For example, a charging device (2), an exposing device (3), a developing apparatus (4), an intermediate transfer medium (6), a supporting roller (7), and a transfer roller (8) are provided around the electrostatic latent image bearing members (1). This image forming apparatus includes a paper-feeding cassette (not illustrated) containing a plurality of recording paper sheets. The recording paper sheets (P) contained in the paper-feeding cassette are fed one by one to between the intermediate transfer medium (6) and the transfer roller (8), followed by fixing with a fixing unit (19). Until fed to therebetween, the recording paper sheets are retained with a pair of registration rollers (not illustrated) so that it can be fed at a desired timing.

In this image forming apparatus, the electrostatic latent image bearing members (1) is uniformly charged with the charging device (2) while being rotated clockwise in FIG. 4. Then, the electrostatic latent image bearing member (1) is irradiated with laser beams modulated by image date from the exposing device (3), to thereby form an electrostatic latent image on the electrostatic latent image bearing member (1). The electrostatic latent image formed on the electrostatic latent image bearing member (1) is developed with the toner using the developing apparatus (4). Next, a toner image, which has formed by applying the toner to the electrostatic latent image bearing member (1) with the developing apparatus (4), is transferred from the electrostatic latent image bearing member (1) to the intermediate transfer medium. The above-described process is repeatedly performed in four colors of cyan (C), magenta (M), yellow (Y) and black (K), to thereby form a full color toner image.

Figure 5:
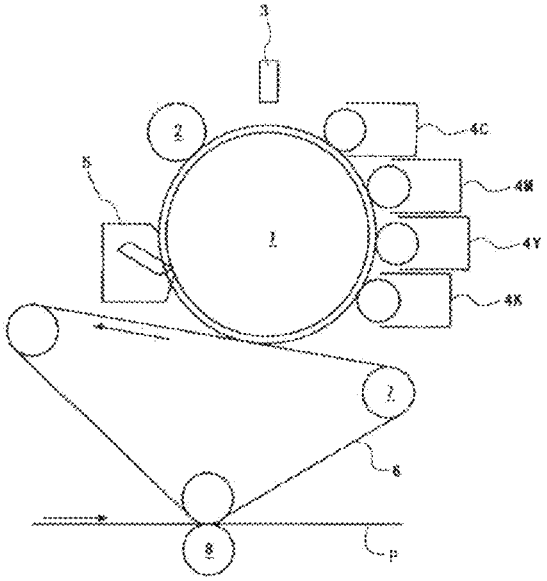
FIG. 5 is a schematic view of one exemplary revolver-type, full-color image forming apparatus of the present invention.

FIG. 5 is a schematic view of one exemplary revolver-type, full-color image forming apparatus.

This image forming apparatus switches the operation of each of developing apparatus (4C, 4M, 4Y, 4K) to thereby sequentially apply color toners onto one electrostatic latent image bearing member (1) for development. The transfer roller (8) is used to transfer the color toner image from the intermediate transfer medium (6) onto the recording paper sheet (P), and then convey the recording paper sheet (P) on which the toner image has been transferred to a fixing portion to thereby obtain a fixed image.

Meanwhile, in the image forming apparatus, the electrostatic latent image bearing member (1), from which the toner image has been transferred to the recording paper sheet (P) by the intermediate transfer member (6), is further rotated, and the residual toner remaining on the surface of the electrostatic latent image bearing member (1) is removed by scraping with a blade at the cleaning portion (5), followed by charge-eliminating by a charge-eliminating portion. The image forming apparatus enters into the next image formation operation after uniformly charging the electrostatic latent image bearing member (1), which has been charge-eliminated by the charge-eliminating portion, by the charging device (2). Notably, the cleaning portion (5) is not limited to those configured to scrape with a blade the toner remaining on the electrostatic latent image bearing member (1). For example, a fur brush may be used for scraping the toner remaining on the electrostatic latent image bearing member (1).

The image forming method and the image forming apparatus of the present invention use as the developer the toner of the present invention, and thus can provide good images.

(Process Cartridge)

A process cartridge of the present invention includes at least the electrostatic latent image bearing member, the electrostatic latent image forming unit, and the developing unit; and, if necessary, further includes appropriately selected other units such as a charging unit, a developing unit, a transfer unit, a cleaning unit and a charge-eliminating unit. The process cartridge is detachably mounted to a main body of the image forming apparatus.

The developing unit includes at least a toner container configured to contain the toner of the present invention, and a toner bearing member configured to bear and convey the toner contained in the toner container; and, optionally, further includes, for example, a layer thickness-regulating member configured to regulate a layer thickness of the toner on the developer bearing member. The process cartridge of the present invention can be mounted detachably to various electrophotographic apparatuses, facsimiles and printers. Preferably, it is mounted detachably to the below-described image forming apparatus of the present invention.

Figure 6:
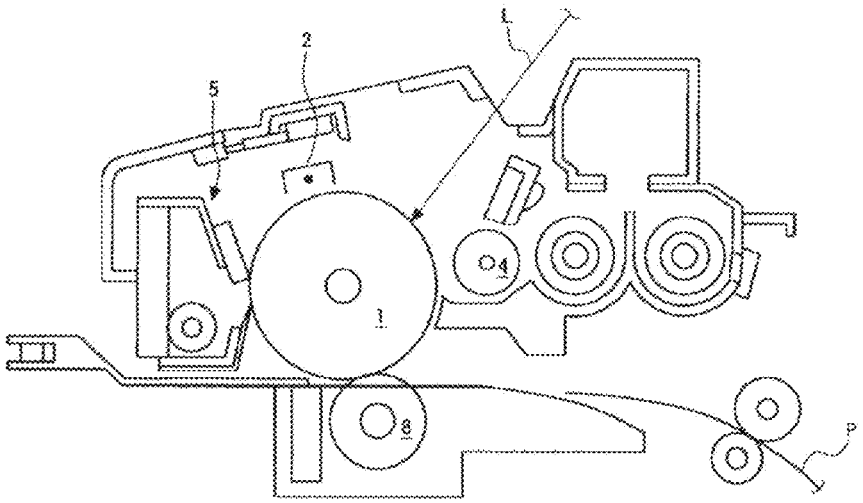
FIG. 6 is a view of one exemplary process cartridge of the present invention.

As illustrated in FIG. 6, the process cartridge includes a built-in electrostatic latent image bearing member (1), a charging device (2), a developing apparatus (4), a transfer roller (8) and a cleaning portion (5); and, if necessary, further includes other units. In FIG. 6, (L) denotes light emitted from an exposing device and (P) denotes a recording paper sheet. The electrostatic latent image bearing member (1) may be the same as that used in the above-described image forming apparatus. The charging device (2) may be any charging member.

Next, description will be given to image forming process by the process cartridge illustrated in the figure. While being rotated clockwise, the electrostatic latent image bearing member (1) is charged with the charging device (2) and then is exposed to light (L) emitted from an exposing unit (not illustrated) while being rotated in a direction indicated by an arrow. As a result, an electrostatic latent image corresponding to an exposure pattern is formed on the electrostatic latent image bearing member. The electrostatic latent image is developed with the toner by the developing apparatus (4). The developed toner image is transferred with the transfer roller (8) onto the recording paper sheet (P), which is then printed out. Next, the surface of the electrostatic latent image bearing member from which the toner image has been transferred is cleaned at the cleaning portion (5), and is charge-eliminated by a charge-eliminating unit (not illustrated). Then, the above-described process is repeatedly performed.

EXAMPLES

The present invention now will be more specifically described with reference to the following Examples, but the present invention is not limited thereto. Notably, "part(s)" and "%" described in Examples mean "part(s) by mass" and "% by mass", respectively, unless otherwise stated.

The method for analyzing and evaluating toners obtained in Examples and Comparative Examples will be described.

—Measurement Method of Extracted Amount of Releasing Agent—

The extracted amount of the releasing agent extracted with hexane from the toner was measured according to the following method.

Specifically, 1.0 g of a toner was weighed, and 7 mL of n-hexane was added thereto. The resultant was stirred with a roll mill at 120 rpm for 1 min at 23° C. to thereby obtain a solution. Then, the resultant solution was subjected to suction filtration and vacuum drying to thereby remove n-hexane. The resultant residue was weighed in mg, which was determined as the extracted amount of the releasing agent (mg per 1 g of toner; herein may be referred to as mg/g for convenience).

—Measurement of Total Free Silicone Oil Amount—

The total free silicone oil amount (amount of free silicone oil) in the toner was measured by a quantitative method including the following steps (1) to (3):

(1) Extraction of Free Silicone Oil

A sample toner was immersed in chloroform, stirred, and left to stand. A supernatant was removed by centrifugal separation to thereby obtain a solid content. Chloroform was added to the solid content, and the resultant was stirred, and left to stand.

The above procedures were repeated to remove free silicone oil from the sample.

(2) Quantification of Carbon Content

The carbon content in the sample from which the free silicone oil had been removed was quantified by CHN elemental analyzer (CHN CORDER MT-5; product of Yanaco Technical Science Co., Ltd.).

(3) Quantification of Total Free Silicone Oil Amount

The total free silicone oil amount was calculated by the following Equation (1).

$$\text{Total free silicone oil amount}=(C0-C1)/C\times100\times37/12(\%\text{ by mass}) \quad \text{Equation (1)}$$

In the above equation,

"C" denotes a carbon content (% by mass) in the silicone oil serving as the treating agent, "C0" denotes a carbon content (% by mass) in the sample before the extraction, "C1" denotes a carbon content (% by mass) in the sample after the extraction, and the coefficient "37/12" denotes the conversion factor for converting the C (carbon) amount in a structure of polydimethylsiloxane to the total amount.

—Method for Measuring Volume Average Particle Diameter and Number Average Particle Diameter—

The volume average particle diameter, the number average particle diameter, and the particle size distribution were determined as follows.

As for a measurement device used in a coulter counter method, COULTER MULTISIZER II (product of Beckman Coulter, Inc.) was used.

First, 0.1 mL to 5 mL of a surfactant (an alkylbenzene sulfonic acid salt) serving as a dispersant was added to 100 mL to 150 mL of an electrolyte solution. Here, the electrolyte solution is an about 1% aqueous NaCl solution prepared using 1st grade sodium chloride, and, for example, ISOTON-II (product of Beckman Coulter, Inc.) can be used. Subsequently, a measurement sample (solid content: 2 mg to 20 mg) was suspended in the resultant solution. The resultant electrolyte solution, in which the sample had been dispersed, was dispersed with an ultrasonic wave disperser for about 1 min to about 3 min. The thus-obtained dispersion liquid was analyzed with the above-listed measurement device using an aperture of 100 μm to measure the number and volume of the toner particles or the toner. Based on the number and the volume, the volume distribution and the number distribution were calculated. From thus-obtained distributions, the volume average particle diameter (Dv) and number average particle diameter (Dn) of the toner were determined.

Notably, in this measurement, 13 channels were used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) were subjected to the measurement.

—Measurement Method of Average Circularity—

The average circularity of the toner was determined as an average circularity measured using a flow-type particle image analyzer FPIA-3000. Specifically, 0.1 mL to 0.5 mL of a surfactant (an alkylbenzene sulfonic acid salt) serving as a dispersant was added into 100 mL to 150 mL of water in a container, from which solid impurities had previously been removed. Then, about 0.1 g to about 0.5 g of a measurement sample was added to the container. The resultant was dispersed with an ultrasonic wave disperser for about 1 min to about 3 min. The concentration of the resultant dispersion liquid was adjusted such that the number of particles of the sample was 3,000 per microliter to 10,000 per microliter. In this state, the shape and distribution of the toner are measured using the analyzer to thereby determine the average circularity.

—Volume Average Particle Diameter of Resin Particles—

The volume average particle diameter of the resin particles was measured by a nanotrack particle size distribution measuring device UPA-EX 150 (product of Nikkiso Co., Ltd., dynamic light scattering/laser doppler method). Specifically, a dispersion in which the resin particles were dispersed was adjusted to have the concentration within the measuring concentration range, followed by measuring. For the measurement, only a dispersion medium of the dispersion liquid was used to measure a background in advance. In accordance with this measuring method, the volume average particle diameter can be measured in the order of several ten nanometers to several micrometers, which was the range of the volume average particle diameter of the resin particles for use in the present invention.

—Molecular Weight—

The molecular weight of the polyester resin or the vinyl-based copolymer resin to be used was measured by the conventional gel permeation chromatography (GPC) under the following conditions.

Device: HLC-8220GPC (product of Tosoh Corporation)
Column: TSK gel Super HZM-M×3
Temperature: 40° C.
Solvent: tetrahydrofuran (THF)
Flow rate: 0.35 mL/min
Sample: 0.01 mL of the sample having a concentration of 0.05% to 0.6% was injected.

From the molecular weight distribution of the toner resin measured under the conditions above, the weight average molecular weight (Mw) and the peak top molecular weight (Mp) were calculated using a molecular weight calibration curve produced from a monodispersed polystyrene standard sample. As for the monodispersed polystyrene standard sample, monodispersed polystyrenes having the weight average molecular weights of 5.8×100, 1.085×10,000, 5.95×10,000, 3.2×100,000, 2.56×1,000,000, 2.93×1,000, 2.85×10,000, 1.48×100,000, 8.417×100,000, and 7.5×1,000,000 (ten samples in total) were used.

<Production of External Additive Surface-Treated with Silicone Oil>

(Silica 1)

Polydimethylsiloxane serving as silicone oil (20 parts by mass) (KF96-300CS, product of Shin-Etsu Chemical Co., Ltd., viscosity: 300 cs) was dissolved into hexane (30 parts by mass), followed by dispersing silica (100 parts by mass) (OX50, product of Nippon Aerosil Co., Ltd.) thereinto while stirring and insonating.

The resultant dispersion was purged with nitrogen, placed under stirring, and then treated at 200° C. for 15 min while stirring to thereby obtain [silica 1] which is inorganic particles surface-treated with silicone oil in an amount of 4 $mg/m^2$ surface area of the external additive.

The [silica 1] was found to have the number average particle diameter of 35 nm and the total free silicone oil amount of 13.7% by mass.

<Synthesis of Non-Crystalline Polyester>

(Polyester 1)

A reaction vessel equipped with a condenser, a stirrer and a nitrogen-introducing pipe was charged with bisphenol A ethylene oxide 2 mol adduct (2,765 parts by mass), bisphenol A propylene oxide 2 mol adduct (480 parts by mass), terephthalic acid (1,100 parts by mass), adipic acid (225 parts by mass) and dibutyl tinoxide (10 parts by mass), followed by reaction at 230° C. for 8 hours under normal pressure. Then, the resultant reaction mixture was allowed to react for 5 hours under a reduced pressure of 10 mmHg to 15 mmHg. Thereafter, trimellitic anhydride (130 parts by mass) was added to the reaction vessel, followed by reaction at 180° C. for 2 hours under normal pressure, to thereby obtain [polyester 1].

The thus-obtained [polyester 1] was found to have the number average molecular weight of 2,200, the weight average molecular weight of 5,600, the glass transition temperature (Tg) of 43° C. and the acid value of 24.

(Polyester 2)

A reaction vessel equipped with a condenser, a stirrer and a nitrogen-introducing pipe was charged with bisphenol A ethylene oxide 2 mol adduct (264 parts by mass), bisphenol A propylene oxide 2 mol adduct (523 parts by mass), terephthalic acid (123 parts by mass), adipic acid (173 parts by mass) and dibutyl tinoxide (1 part by mass), followed by reaction at 230° C. for 8 hours under normal pressure. Then, the resultant reaction mixture was allowed to react for 8 hours under a reduced pressure of 10 mmHg to 15 mmHg. Thereafter, trimellitic anhydride (26 parts by mass) was added to the reaction vessel, followed by reaction at 180° C. for 2 hours under normal pressure, to thereby obtain [polyester 2].

The thus-obtained [polyester 2] was found to have the number average molecular weight of 4,000, the weight average molecular weight of 47,000, the glass transition temperature of 65° C. and the acid value of 12.

<Synthesis of Crystalline Polyester>

(Polyester 3)

A reaction vessel equipped with a condenser, a stirrer and a nitrogen-introducing pipe was charged with 1,6-hexanediol (500 parts by mass), succinic acid (500 parts by mass), and dibutyl tin oxide (2.5 parts by mass), followed by reaction at 200° C. for 8 hours under normal pressure. Then, the resultant reaction mixture was allowed to react for 1 hour under a reduced pressure of 10 mmHg to 15 mmHg to thereby obtain [polyester 3].

The thus-obtained [polyester 3] exhibited an endothermic peak at 65° C. in the DSC measurement.

<Synthesis of Synthetic Ester Wax>

To a 4-necked flask reaction device equipped with a Dimroth condenser and a Dean-Stark water separator, were added benzene (1,740 parts by mass), a mixture of behenic acid and stearic acid (behenic acid:stearic acid=8:2 (in molar ratio)) serving as a long-chain alkyl carboxylic acid component (1,300 parts by mass), a mixture of behenyl alcohol and stearyl alcohol (behenyl alcohol:stearyl alcohol=5:5 (in molar ratio)) serving as a long-chain alkyl alcohol component (1,200 parts by mass), and p-toluenesulfonic acid (120 parts by mass). The resultant was thoroughly stirred to thereby dissolve the above solid components, followed by refluxing for 5 hours. Thereafter, a valve of the water separator was opened and azeotropic distillation was performed.

Next, the resultant was thoroughly washed with sodium bicarbonate, followed by drying to evaporate off benzene.

The resultant product was recrystallized, washed, and purified to thereby obtain [synthetic ester wax 1].

The thus-obtained [synthetic ester wax 1] was found to have the melting point of 70° C. as measured by DSC measurement.

<Synthesis of Releasing Agent Dispersant>

To an autoclave reaction vessel equipped with a thermometer and a stirrer, were added xylene (600 parts by mass), and a low-molecular weight polyethylene (SANWAX LEL-400, product of Sanyo Chemical Industries, Ltd., softening point: 128° C.) (300 parts by mass). The low-molecular weight polyethylene was allowed to be sufficiently dissolved into xylene. After purging with nitrogen, a mix solution of styrene (2,310 parts by mass), acrylonitrile (270 parts by mass), butyl acrylate (150 parts by mass), di-t-butylperoxyhexahydroterephthalate (78 parts by mass), and xylene (455 parts by mass) was added dropwise thereto at 175° C. for 3 hours to thereby allow to polymerize. Thereafter, the resultant was maintained at the same temperature for 30 min, followed by desolvation to thereby obtain [releasing agent dispersant 1].

<Synthesis of Prepolymer>

A reaction vessel equipped with a condenser, a stirrer and a nitrogen-introducing pipe was charged with 1,2-propyleneglycol (366 parts by mass), terephthalic acid (566 parts by mass), trimellitic anhydride (44 parts by mass) and titanium tetrabutoxide (6 parts by mass), followed by reaction at 230° C. for 8 hours under normal pressure. Then, the resultant reaction mixture was allowed to react for 5 hours under a reduced pressure of 10 mmHg to 15 mmHg, to thereby obtain [intermediate polyester 1].

The thus-obtained [intermediate polyester 1] was found to have the number average molecular weight of 3,200, the weight average molecular weight of 12,000, and the glass transition temperature (Tg) of 55° C.

Next, a reaction vessel equipped with a condenser, a stirrer and a nitrogen-introducing pipe was charged with the [intermediate polyester 1] (420 parts by mass), isophorone diisocyanate (80 parts by mass) and ethyl acetate (500 parts by mass), followed by reaction at 100° C. for 5 hours, to thereby obtain [prepolymer].

The thus-obtained [prepolymer] was found to have the free isocyanate amount of 1.34% by mass.

<Production of Resin Particles Dispersion Liquid for Shell Layer>

(Vinyl-Based Copolymer Resin Particles V-1)

A reaction vessel equipped with a condenser, a stirrer and a nitrogen-introducing pipe was charged with sodium dodecyl sulfate (1.6 parts by mass) and ion-exchanged water (492 parts by mass), followed by heating to 80° C. Then, a solution of potassium persulfate (2.5 parts by mass) in ion-exchanged water (100 parts by mass) was added to the resultant solution. Fifteen min after the addition, to the resultant, was added dropwise a mixture of a styrene monomer (160 parts by mass), butyl acrylate monomer (40 parts by mass), and n-octylmercaptan (3.5 parts by mass) for 90 min. Subsequently, the temperature of the resultant was maintained at 80° C. for 60 min, followed by cooling to obtain a dispersion liquid of [vinyl-based copolymer resin particles V-1].

The thus-obtained [vinyl-based copolymer resin particles V-1] was found to have the solid content concentration of 25% by mass, and the volume average particle diameter of 130 nm. Subsequently, the dispersion liquid was added to a petri dish in a small amount, where a dispersion medium thereof was evaporated off. The resultant solid matter was found to have the number average molecular weight of 11,000, the weight average molecular weight of 18,000, and Tg of 83° C.

<Preparation of Masterbatch>

Carbon black (40 parts by mass) (REGAL 400R, product of Cabot Corporation), a polyester resin serving as the binder resin (60 parts by mass) (RS-801, product of Sanyo Chemical Industries, Ltd., acid value: 10, Mw: 20,000, Tg: 64° C.) and water (30 parts by mass) were mixed together using HENSCHEL MIXER, to thereby obtain a mixture containing pigment aggregates impregnated with water. The resultant mixture was kneaded for 45 min with a two-roll mill of which roll surface temperature had been set to 130° C., followed by pulverizing with a pulverizer so as to have a diameter of 1 mm to thereby obtain [masterbatch 1].

Production Example 1

Production of Toner 1

<Preparation of Oil Phase>

A vessel equipped with a stirring rod and a thermometer was charged with [polyester 1] (4 parts by mass), [polyester 3] (20 parts by mass), [synthetic ester wax 1] (20 parts by mass), [releasing agent dispersant 1] (30 parts by mass) and ethyl acetate (96 parts by mass). The resultant mixture was heated to 80° C. under stirring, maintained at 80° C. for 5 hours, and then cooled to 30° C. for 1 hour. Then, the [masterbatch 1] (50 parts by mass) was added thereto, followed by mixing for 1 hour. The resultant was transferred to another vessel, and then dispersed with a bead mill (ULTRA VISCOMILL, product of AIMEX CO., Ltd.) under the following conditions: a liquid feed rate of 1 kg/hr, disc circumferential velocity of 6 m/s, 0.5 mm-zirconia beads packed to 80% by volume, and 3 passes, to thereby obtain [raw material solution 1]. Next, to the total amount of [raw material solution 1] (220 parts by mass), were added a 70% ethyl acetate solution of [polyester 1] (194 parts by mass), [polyester 2] (57 parts by mass), and ethyl acetate (57 parts by mass), followed by stirring with THREE-ONE MOTOR (product of Yamato Scientific Co., Ltd.) for 2 hours, to thereby obtain [pigment/wax dispersion liquid 1]. The thus-obtained [pigment/wax dispersion liquid 1] was mixed for 1 min at 5,000 rpm with TK HOMOMIXER (product of PRIMIX Corporation). Then, [prepolymer] (40 parts by mass) was added to the [pigment/wax dispersion liquid 1]. The resultant mixture was mixed for 1 min at 5,000 rpm with TK HOMOMIXER, to thereby obtain [oil phase 1]. The solid content of the [oil phase 1] was adjusted with ethyl acetate to 49% by mass (measured at 130° C. for 30 min).

<Preparation of Aqueous Phase>

Ion-exchanged water (472 parts by mass), a 50% sodium dodecyl diphenyl ether disulfonate aqueous solution (81 parts by mass) (ELEMINOL MON-7, product of Sanyo Chemical Industries Ltd.), a 1% carboxy methyl cellulose aqueous solution serving as a thickener (67 parts by mass), and ethyl acetate (54 parts by mass) were mixed and stirred to thereby obtain an opaque white liquid, which was used as [aqueous phase 1].

<Emulsification Step>

The total amount of the [oil phase 1] was mixed by means of TK HOMOMIXER at 5,000 rpm for 1 min, and then the [aqueous phase 1] (860 parts by mass) was added thereto. The resultant mixture was mixed by means of TK HOMOMIXER for 20 min while adjusting the revolution speed thereof in the range of 8,000 rpm to 13,000 rpm, to thereby obtain [core particle slurry 1].

<Shell Formation Step (Attachment Step of Resin Particles to Core Particles)>

While stirring the [core particle slurry 1] by means of THREE-ONE MOTOR at 200 rpm, [vinyl-based copolymer resin particles V-1] (57 parts by mass) was added dropwise thereto for 5 min, followed by continuing stirring for 30 min. Thereafter, a small amount of the slurry was sampled, and diluted with water in amount of 10 times of the sample. The resultant was subjected to centrifugal separation by means of a centrifugal separator. As a result, toner base particles were settled on the bottom of a test tube, and the supernatant was substantially clear. Thus, [slurry after formation of shell 1] was obtained.

<Desolvation>

A vessel equipped with a stirrer and a thermometer was charged with [slurry after formation of shell 1], followed by desolvation at 30° C. for 8 hours to thereby obtain [dispersion slurry 1].

<Washing/Drying>

The thus-obtained [dispersion slurry 1] (100 parts by mass) was filtrated under a reduced pressure, and then the following treatments were performed.

(1) Ion-exchanged water (100 parts by mass) was added to the resultant filtration cake, followed by mixing with TK HOMOMIXER (at 12,000 rpm for 10 min) and filtrating.

(2) Ion-exchanged water (100 parts by mass) was added to the filtration cake obtained in (1). The resultant was mixed with TK HOMOMIXER (at 12,000 rpm for 30 min) under application of ultrasonic vibration, followed by filtrating under a reduced pressure. This treatment was repeated until the reslurry had an electrical conductivity of 10 μC/cm or lower.

(3) To the reslurry obtained in (2), was added 10% hydrochloric acid so as to have a pH of 4, followed by stirring for 30 min with THREE-ONE MOTOR and filtrating.

(4) Ion-exchanged water (100 parts by mass) was added to the filtration cake obtained in (3), followed by mixing with TK HOMOMIXER (at 12,000 rpm for 10 min) and filtrating. This treatment was repeated until the reslurry had an electrical conductivity of 10 μC/cm or lower, to thereby obtain [filtration cake 1]. The remaining [dispersion slurry 1] was also washed in the same manner. The resultant was additionally mixed to the [filtration cake 1].

The [filtration cake 1] was dried with an air-circulation dryer at 45° C. for 48 hours, and then sieved with a mesh having an opening size of 75 μm to obtain [toner base particles 1].

The [toner base particles 1] (100 parts by mass) was mixed with [silica 1] (1.5 parts by mass) and hydrophobic silica 112000 (number average particle diameter of primary particles: about 10 nm, product of Wacker Chemie AG) (1 parts by mass) using HENSCHEL MIXER to thereby obtain toner 1.

The toner 1 was found to have the average circularity of 0.97.

Production Example 2

Production of Toner 2

Toner 2 was obtained in the same manner as in Production Example 1, except that [raw material solution 2] was prepared by changing the amount of the [releasing agent dispersant 1] in the [raw material solution 1] from 30 parts by mass to 20 parts by mass, and 210 parts by mass of the [raw material solution 2] was used instead of 220 parts by mass of the [raw material solution 1].

Production Example 3

Production of Toner 3

Toner 3 was obtained in the same manner as in Production Example 1, except that [raw material solution 3] was prepared by changing the amount of the [releasing agent dispersant 1] in the [raw material solution 1] from 30 parts by mass to 10 parts by mass, and that 200 parts by mass of the [raw material solution 3] was used instead of 220 parts by mass of the [raw material solution 1].

Production Example 4

Production of Toner 4

Toner 4 was obtained in the same manner as in Production Example 1, except that [raw material solution 4] was prepared by changing the amount of the [releasing agent dispersant 1] in the [raw material solution 1] from 30 parts by mass to 34 parts by mass, and that 224 parts by mass of the [raw material solution 4] was used instead of 220 parts by mass of the [raw material solution 1].

Production Example 5

Production of Toner 5

Toner 5 was obtained in the same manner as in Production Example 1, except that [raw material solution 5] was prepared by changing the amount of the [releasing agent dispersant 1] in the [raw material solution 1] from 30 parts by mass to 4 parts by mass, and that 194 parts by mass of the [raw material solution 5] was used instead of 220 parts by mass of the [raw material solution 1].

Production Example 6

Production of Toner 6

Toner 6 was obtained in the same manner as in Production Example 3, except that the amount of [silica 1] was changed from 1.5 parts by mass to 3.8 parts by mass.

The amount of the releasing agent, the amount of the releasing agent dispersant, the ratio of the amount of the releasing agent dispersant to that of the releasing agent, the extracted amount of the releasing agent, and the total amount of free silicone oil in the toners 1 to 6 obtained in the Production Examples 1 to 6 are showed in Table 1.

Notably, the extracted amount of the releasing agent and the total amount of free silicone oil were determined according to the above procedure.

TABLE 1

| | Amount of synthetic ester wax 1 (parts by mass) | Releasing agent dispersant 1 Amount (parts by mass) | Ratio to the amount of releasing agent (% by mass) | Extracted amount of releasing agent (mg/g) | Total amount of free silicone oil (% by mass) | Toner Circularity |
|---|---|---|---|---|---|---|
| Toner 1 | 7 | 10.5 | 150 | 11 | 0.2 | 0.989 |
| Toner 2 | 7 | 7.0 | 100 | 18 | 0.2 | 0.970 |
| Toner 3 | 7 | 3.5 | 50 | 24 | 0.2 | 0.961 |
| Toner 4 | 7 | 11.9 | 170 | 9 | 0.2 | 0.990 |
| Toner 5 | 7 | 1.4 | 20 | 26 | 0.2 | 0.957 |
| Toner 6 | 7 | 3.5 | 50 | 24 | 0.5 | 0.961 |

Example 1

The image forming apparatus of Example 1 was produced in which IPSIO SP C220 (product of Ricoh Company, Ltd.) was used as the image forming apparatus illustrated in FIG. 4; the toner 1 was contained in a toner container in a developing unit; the contact pressure (developing pressure) between an electrostatic latent image bearing member and a toner bearing member was set to $2.0\times10^4$ N/m$^2$; and the circumferential speed ratio Cd/Cp of a circumferential speed of the toner bearing member Cd (m/sec) to a circumferential speed of the electrostatic latent image bearing member Cp (m/sec) was set to 1.5.

[Contact Pressure Between Electrostatic Latent Image Bearing Member and Toner Bearing Member]

The contact pressure between the electrostatic latent image bearing member and the toner bearing member was measured as follows.

Figure 7:
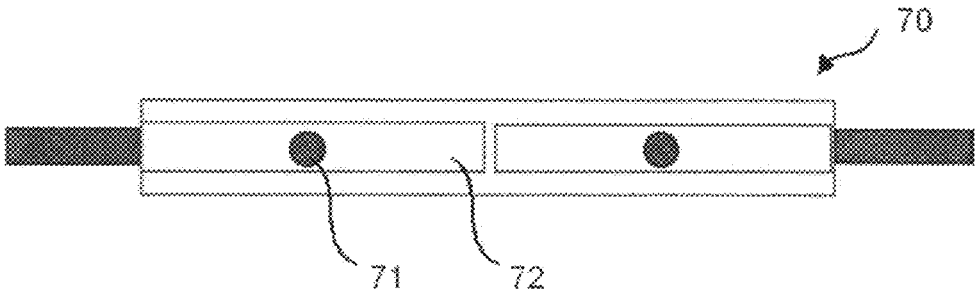
FIG. 7 is a view of a pressure measuring device used for measuring a contact pressure between an electrostatic latent image bearing member and a toner bearing member.

FIG. 7 is a view of a pressure measuring device 70 used for measuring a contact pressure between an electrostatic latent image bearing member and a toner bearing member. The pressure measuring device 70 had the same diameter and width as the electrostatic latent image bearing member, and includes a plate member 72 capable of detecting a load using a load cell 71 at a position being in contact with the toner bearing member of the pressure measuring device 70. A small-sized compression load cells (LMA-A, capacity range: 5 N to 50 N, product of KYOWA ELECTRONIC INSTRUMENTS CO., LTD.) was used as the load cell 71.

This pressure measuring device 70 was integrated into the image forming apparatus of Example 1 instead of the electrostatic latent image bearing member. A developing pressure [N/m$^2$] was determined by dividing a static load which is applied to the load cell 71 [N] by a nip distance [m] and a nip width [m].

<Evaluation>

The thus-produced image forming apparatus was evaluated for high temperature offset, contamination of the electrostatic latent image bearing member, a white void at an image end portion, and granularity according to the following evaluating method. The results are shown in Table 2-2.

<<High Temperature Offset>>

An unfixed image was produced by printing a solid image (width: 36 mm) on an A4-sized sheet (vertical-feed) up to a distance of 3 mm from the front end using the image forming apparatus of Example 1.

A test device was produced by taking out a fixing device of IPSIO SP C220 (product of Ricoh Company, Ltd.) and modifying it so as to be capable of controlling the temperature. The test device was used to fix the unfixed image at a fixing temperature of 110° C. to 190° C. in 10° C. steps. The resultant fixed image was measured for glossiness by a glossmeter (PG-1M, product of NIPPON DENSHOKU INDUSTRIES CO., LTD.).

Based on the temperature at which offset was occurred and the glossiness began to decrease, the evaluation was performed according to the following criteria.

—Evaluation Criteria—

A: The temperature at which the glossiness began to decrease was 190° C. or more.

B: The temperature at which the glossiness began to decrease was 180° C. or more but less than 190° C.

C: The temperature at which the glossiness began to decrease was 170° C. or more but less than 180° C.

D: The temperature at which the glossiness began to decrease was less than 170° C.

In the above evaluation criteria, A to C are practicable.

<<Contamination of Electrostatic Latent Image Bearing Member>>

A printing pattern (coverage rate: 1%) was continuously printed on 5,000 sheets of paper under N/N environment (temperature: 23° C., 45% RH) using the image forming apparatus of Example 1. Then, a solid image was printed, followed by visually observing and evaluating the electrostatic latent image bearing member and the solid image according to the following evaluation criteria.

—Evaluation Criteria—

A: The electrostatic latent image bearing member was not contaminated and there was no image defect.

B: The electrostatic latent image bearing member was contaminated but there was no image defect.

C: The electrostatic latent image bearing member was contaminated and these were some small black spots on the image, which was not problematic in practical use.

D: The electrostatic latent image bearing member was contaminated and these were many small black spots on the image, which was problematic in practical use.

<<White Void at Image End Portion>>

A halftone printing pattern was printed using the image forming apparatus of Example 1, followed by evaluating according to the following evaluation criteria.

—Evaluation Criteria—

A: There was no white void at the image end portion and good image was obtained.

B: There was some unevenness in image density at the image end portion, which was not problematic in practical use.

C: There were some image defects at the image end portion, which was not problematic in practical use.

D: There were image defects at the image end portion, which was problematic in practical use.

<<Granularity>>

An image was outputted by IPSIO SP C220 (product of Ricoh Company, Ltd.) so as to have an average brightness of 40 to 80 at a halftone portion. Then, the outputted image was read by a scanner (NEXSCAN4100, product of Heidelberger Druckmaschinen AG). Thereafter, an average value of granularity in the image was calculated according to the below described Equation (2), which was determined as an average granularity.

The noise characteristic (roughness) of an image can be quantified by determining the granularity of the outputted image according to the above method.

As seen from the definition described below, the granularity is an index of the noise characteristic of an image. The numerical value of the granularity is small when the image is good in roughness, and increases as the roughness is deteriorated.

—Evaluation Criteria—

A: 0.15 or less

B: more than 0.15 and 0.20 or less

C: more than 0.20 and 0.25 or less

D: more than 0.25

In the above evaluation criteria, A to C are practicable.

The graininess is generally considered as an index of high image quality, and is basic property of image quality. The graininess is defined as "subjective evaluation measure representing the degree of roughness of image which should be uniform in image density."

The granularity is an objective evaluation measure of the graininess which is subjective evaluation measure.

For example, the granularity has been defined using a Winer Spectrum, which is a power spectrum of an image density variation.

Dooley and Shaw (Xerox Corporation) defined the granularity (GS) as a value which is obtained by cascading and then integrating the Wiener Spectrum and Visual Transfer Function (VTF) of an image (see the following Equation (1); and, for further details, see Dooley, Rshaw Noise Perception in lectrophotography, J. Appl. Photogr. Eng., 5, 4, pp 190-196).

$$GS=\exp(-1.8D)\int(\mathrm{WS}(f))^{1/2}\mathrm{VTF}(f)df \quad \text{Equation (1)}$$

where

D denotes the average image density, f denotes the spatial frequency (c/mm),

WS (f) denotes Winer Spectrum, and

VTF (f) denotes Visual Transfer Function.

In the present invention, the granularity is represented by the following Equation (2), which is obtained by further developing the GS granularity (Dooley and Shaw).

$$\text{Granularity}=\exp(aL^*+b)\int(\mathrm{WS}L(f))^{1/2}\mathrm{VTF}(f)df \quad \text{Equation (2)}$$

where

L* denotes the average brightness, f denotes the spatial frequency (c/mm),

WSL (f) denotes the power spectrum of brightness distribution,

VTF (f) denotes Visual Transfer Function, a denotes a coefficient (a=0.1044), and b denotes a coefficient (b=0.8944).

In the Equation (2), the brightness L* is used instead of the image density D.

The granularity calculated according to Equation (2) is advantageous in being superior in the linearity in the color space and adaptability with color images to that of Equation (1).

In the present invention, the granularity is calculated according to the Equation (2) (for more details, see "Method of evaluating noise of a halftone color image" Japan Hardcopy '96 Proceedings, p. 189).

Examples 2 to 6 and 9 to 12

Image forming apparatus of Examples 2 to 6 and 9 to 12 were produced and evaluated in the same manner as in Example 1, except that toners and process conditions, i.e., the contact pressures (developing pressures) between the electrostatic latent image bearing member and the toner bearing member described in Table 2-1 were used. The results are shown in Table 2-2.

Examples 7 and 8

Examples 7 and 8 were evaluated in the same manner as in Examples 5 and 6, except that the deteriorated toner was removed as described in Table 2-1, and the contamination of the electrostatic latent image bearing member was evaluated as follows. The results are shown in Table 2-2.

<<Contamination of Electrostatic Latent Image Bearing Member>>

A printing pattern (coverage rate: 1%) was continuously printed on a 5,000 m sheet of paper under N/N environment (temperature: 23° C., 45% RH) using the image forming apparatus of Examples 5 and 6, provided that, during continuously printing on the 5,000 m sheet of paper, entirely solid images so as to cover an entire circumferential surface of the toner bearing member (toner amount so as to have ID of 1.4 when printed) were outputted as the deteriorated toner removing step (toner refresh controlling step) by the deteriorated toner removing unit (toner refresh controlling unit) per 500 m of traveling distance of the electrostatic latent image bearing member. Then, a fresh toner of which amount corresponds to that of the consumed toner was supplied. Then, a solid image was printed, followed by visually observing and evaluating the electrostatic latent image bearing member and the solid image according to the above evaluation criteria.

Comparative Examples 1 to 8

Image forming apparatus of Comparative Examples 1 to 8 were produced in the same manner as in Example 1, except that toners and process conditions described in Table 2-1 were used. The results are shown in Table 2-2.

TABLE 2-1

| | Toner | | | Process condition | |
|---|---|---|---|---|---|
| | Type | Extracted amount of releasing agent (mg/g) | Total amount of free silicone oil (% by mass) | Developing pressure ($N/m^2$) | Deteriorated toner removal |
| Ex. 1 | Toner 1 | 11 | 0.2 | $2.0 \times 10^4$ | 0 |
| Ex. 2 | Toner 1 | 11 | 0.2 | $7.5 \times 10^4$ | 0 |
| Ex. 3 | Toner 2 | 18 | 0.2 | $5.0 \times 10^4$ | 0 |
| Ex. 4 | Toner 3 | 24 | 0.2 | $2.0 \times 10^4$ | 0 |
| Ex. 5 | Toner 3 | 24 | 0.2 | $7.5 \times 10^4$ | 0 |
| Ex. 6 | Toner 6 | 24 | 0.5 | $7.5 \times 10^4$ | 0 |
| Ex. 7 | Toner 3 | 24 | 0.2 | $7.5 \times 10^4$ | Amount to allow a toner to be borne on at least an entire circumferential surface of toner bearing member |
| Ex. 8 | Toner 6 | 24 | 0.5 | $7.5 \times 10^4$ | Amount to allow a toner to be borne on at least an entire circumferential surface of toner bearing member |
| Ex. 9 | Toner 1 | 11 | 0.2 | $5.0 \times 10^4$ | 0 |
| Ex. 10 | Toner 2 | 18 | 0.2 | $7.5 \times 10^4$ | 0 |
| Ex. 11 | Toner 2 | 18 | 0.2 | $2.0 \times 10^4$ | 0 |
| Ex. 12 | Toner 3 | 24 | 0.2 | $5.0 \times 10^4$ | 0 |
| Comp. Ex. 1 | Toner 4 | 9 | 0.2 | $7.5 \times 10^4$ | 0 |
| Comp. Ex. 2 | Toner 4 | 9 | 0.2 | $2.0 \times 10^4$ | 0 |
| Comp. Ex. 3 | Toner 5 | 26 | 0.2 | $2.0 \times 10^4$ | 0 |
| Comp. Ex. 4 | Toner 5 | 26 | 0.2 | $7.5 \times 10^4$ | 0 |
| Comp. Ex. 5 | Toner 1 | 11 | 0.2 | $1.6 \times 10^4$ | 0 |

TABLE 2-1-continued

| | Toner | | | Process condition | |
|---|---|---|---|---|---|
| | Type | Extracted amount of releasing agent (mg/g) | Total amount of free silicone oil (% by mass) | Developing pressure ($N/m^2$) | Deteriorated toner removal |
| Comp. Ex. 6 | Toner 1 | 11 | 0.2 | $7.8 \times 10^4$ | 0 |
| Comp. Ex. 7 | Toner 3 | 24 | 0.2 | $1.6 \times 10^4$ | 0 |
| Comp. Ex. 8 | Toner 3 | 24 | 0.2 | $7.8 \times 10^4$ | 0 |

TABLE 2-2

| | Evaluation | | | |
|---|---|---|---|---|
| | High temperature offset | Contamination of electrostatic latent image bearing member | White void of image end portion | Granularity |
| Ex. 1 | C | A | C | A |
| Ex. 2 | C | C | A | A |
| Ex. 3 | B | B | B | B |
| Ex. 4 | A | B | C | C |
| Ex. 5 | A | C | A | C |
| Ex. 6 | A | B | A | C |
| Ex. 7 | A | B | A | C |
| Ex. 8 | A | A | A | C |
| Ex. 9 | C | B | B | A |
| Ex. 10 | B | C | A | B |
| Ex. 11 | B | B | C | B |
| Ex. 12 | A | B | B | C |
| Comp. Ex. 1 | D | B | A | A |
| Comp. Ex. 2 | D | A | C | A |
| Comp. Ex. 3 | A | D | C | D |
| Comp. Ex. 4 | A | D | A | D |
| Comp. Ex. 5 | C | A | D | A |
| Comp. Ex. 6 | C | D | A | A |
| Comp. Ex. 7 | A | B | D | C |
| Comp. Ex. 8 | A | D | A | C |

Embodiments of the present invention are as follows.

<1> An image forming apparatus, including:

an electrostatic latent image bearing member;

an electrostatic latent image forming unit configured to form an electrostatic latent image on the electrostatic latent image bearing member; and a developing unit containing a toner and configured to develop the electrostatic latent image with the toner to thereby form a visible image, wherein the developing unit is a contact type one-component developing unit which includes a toner bearing member being in contact with the electrostatic latent image bearing member, wherein a contact pressure between the electrostatic latent image bearing member and the toner bearing member is $2.0 \times 10^4$ $N/m^2$ to $7.5 \times 10^4$ $N/m^2$, wherein the toner contains a binder resin and a releasing agent, and wherein an extracted amount of the releasing agent extracted with hexane from the toner is 10 mg/g to 25 mg/g.

<2> The image forming apparatus according to <1>, wherein the toner further contains, as an external additive, inorganic particles surface-treated with silicone oil, and wherein a mass ratio of the silicone oil which is freed from the inorganic particles to the toner is 0.2% by mass to 0.5% by mass.

<3> The image forming apparatus according to <2>, wherein the external additive is at least one selected from the group consisting of silica, titania, and alumina which are surface-treated with silicone oil.

<4> The image forming apparatus according to <3>, wherein the external additive is the silica surface-treated with silicone oil.

<5> The image forming apparatus according to any one of <2> to <4>, wherein an amount of the silicone oil used for surface-treating the external additive is 2 mg/m$^2$ (surface area of the external additive) to 10 mg/m$^2$ (surface area of the external additive).

<6> The image forming apparatus according to any one of <1> to <5>, further including a deteriorated toner removing unit configured to supply the toner to the electrostatic latent image bearing member in an amount to allow the toner to be borne on at least an entire circumferential surface of the toner bearing member to thereby remove a deteriorated toner remaining on the electrostatic latent image bearing member and the toner bearing member.

<7> The image forming apparatus according to any one of <1> to <6>, wherein the toner has an average circularity of 0.96 to 1.00.

<8> The image forming apparatus according to any one of <1> to <7>, wherein a circumferential speed ratio Cd/Cp of a circumferential speed of the toner bearing member Cd (m/sec) to a circumferential speed of the electrostatic latent image bearing member Cp (m/sec) is 1.2 to 1.6.

<9> An image forming method, including forming an electrostatic latent image on an electrostatic latent image bearing member; and developing the electrostatic latent image with a toner to thereby form a visible image, wherein the developing is a contact type one-component developing which uses a toner bearing member being in contact with the electrostatic latent image bearing member, wherein a contact pressure between the electrostatic latent image bearing member and the toner bearing member is $2.0\times10^4$ N/m$^2$ to $7.5\times10^4$ N/m$^2$, wherein the toner contains a binder resin and a releasing agent, and wherein an extracted amount of the releasing agent extracted with hexane from the toner is 10 mg/g to 25 mg/g.

<10> A process cartridge, including:

an electrostatic latent image bearing member;

an electrostatic latent image forming unit configured to form an electrostatic latent image on the electrostatic latent image bearing member; and a developing unit containing a toner and configured to develop the electrostatic latent image with the toner to thereby form a visible image, wherein the developing unit is a contact type one-component developing unit which includes a toner bearing member being in contact with the electrostatic latent image bearing member, wherein a contact pressure between the electrostatic latent image bearing member and the toner bearing member is $2.0\times10^4$ N/m$^2$ to $7.5\times10^4$ N/m$^2$, wherein the toner contains a binder resin and a releasing agent, and wherein an extracted amount of the releasing agent extracted with hexane from the toner is 10 mg/g to 25 mg/g.

This application claims priority to Japanese application No. 2012-261531, filed on Nov. 29, 2012 and incorporated herein by reference.

What is claimed is:

1. An image forming apparatus, comprising:

an electrostatic latent image bearing member;

an electrostatic latent image forming unit configured to form an electrostatic latent image on the electrostatic latent image bearing member;

a developing unit containing a toner and configured to develop the electrostatic latent image with the toner to thereby form a visible image; and a deteriorated toner removing unit configured to supply the toner to the electrostatic latent image bearing member in an amount to allow the toner to be borne on at least an entire circumferential surface of a toner bearing member to thereby remove a deteriorated toner remaining on the electrostatic latent image bearing member and the toner bearing member, wherein the developing unit is a contact type one-component developing unit which comprises the toner bearing member being in contact with the electrostatic latent image bearing member, wherein a contact pressure between the electrostatic latent image bearing member and the toner bearing member is $2.0\times10^4$ N/m$^2$ to $7.5\times10^4$ N/m$^2$, wherein the toner comprises a binder resin and a releasing agent, and wherein an extracted amount of the releasing agent extracted with hexane from the toner is 10 mg/g to 25 mg/g.

2. The image forming apparatus according to claim 1, wherein the toner further comprises, as an external additive, inorganic particles surface-treated with silicone oil, and wherein a mass ratio of the silicone oil which is freed from the inorganic particles to the toner is 0.2% by mass to 0.5% by mass.

3. The image forming apparatus according to claim 2, wherein the external additive is at least one selected from the group consisting of silica, titania, and alumina which are surface-treated with silicone oil.

4. The image forming apparatus according to claim 3, wherein the external additive is the silica surface-treated with silicone oil.

5. The image forming apparatus according to claim 2, wherein an amount of the silicone oil used for surface-treating the external additive is 2 mg/m$^2$ (surface area of the external additive) to 10 mg/m$^2$ (surface area of the external additive).

6. The image forming apparatus according to claim 1, wherein the toner has an average circularity of 0.96 to 1.00.

7. The image forming apparatus according to claim 1, wherein a circumferential speed ratio Cd/Cp of a circumferential speed of the toner bearing member Cd (m/sec) to a circumferential speed of the electrostatic latent image bearing member Cp (m/sec) is 1.2 to 1.6.

8. An image forming method, comprising forming an electrostatic latent image on an electrostatic latent image bearing member;

developing the electrostatic latent image with a toner to thereby form a visible image; and removing deteriorated toner remaining on the electrostatic latent image bearing member and a toner bearing member by supplying the toner to the electrostatic latent image bearing member in an amount to allow the toner to be borne on at least an entire circumferential surface of the toner bearing member, wherein the developing is a contact type one-component developing which uses the toner bearing member being in contact with the electrostatic latent image bearing member, wherein a contact pressure between the electrostatic latent image bearing member and the toner bearing member is $2.0\times10^4$ N/m$^2$ to $7.5\times10^4$ N/m$^2$, wherein the toner comprises a binder resin and a releasing agent, and wherein an extracted amount of the releasing agent extracted with hexane from the toner is 10 mg/g to 25 mg/g.

9. A process cartridge, comprising:

an electrostatic latent image bearing member;

an electrostatic latent image forming unit configured to form an electrostatic latent image on the electrostatic latent image bearing member;

a developing unit containing a toner and configured to develop the electrostatic latent image with the toner to thereby form a visible image; and a deteriorated toner removing unit configured to supply the toner to the electrostatic latent image bearing member in an amount to allow the toner to be borne on at least an entire circumferential surface of a toner bearing member to thereby remove a deteriorated toner remaining on the electrostatic latent image bearing member and the toner bearing member, wherein the developing unit is a contact type one-component developing unit which comprises the toner bearing member being in contact with the electrostatic latent image bearing member, wherein a contact pressure between the electrostatic latent image bearing member and the toner bearing member is $2.0\times10^4$ N/m$^2$ to $7.5\times10^4$ N/m$^2$, wherein the toner comprises a binder resin and a releasing agent, and wherein an extracted amount of the releasing agent extracted with hexane from the toner is 10 mg/g to 25 mg/g.

* * * * *